US008735786B2

(12) United States Patent
Gorman et al.

(10) Patent No.: US 8,735,786 B2
(45) Date of Patent: May 27, 2014

(54) MICROWAVE POPCORN PACKAGE

(75) Inventors: Charles Thomas Gorman, Mahtomedi, MN (US); David W. France, Omaha, NE (US); Clifton Lachmansingh, South Haven, MN (US); Paul John Warosh, Plymouth, MN (US)

(73) Assignee: ConAgra Foods RDM, Inc., Omaha, NE (US)

( * ) Notice: Subject to any disclaimer, the term of this patent is extended or adjusted under 35 U.S.C. 154(b) by 607 days.

(21) Appl. No.: 12/559,094

(22) Filed: Sep. 14, 2009

(65) Prior Publication Data

US 2010/0068353 A1 Mar. 18, 2010

Related U.S. Application Data

(63) Continuation of application No. 11/970,349, filed on Jan. 7, 2008.

(60) Provisional application No. 60/879,142, filed on Jan. 8, 2007.

(51) Int. Cl.
*H05B 6/80* (2006.01)
*B65D 81/34* (2006.01)

(52) U.S. Cl.
USPC ..... 219/730; 219/727; 426/107

(58) Field of Classification Search
USPC ..... 219/730, 727, 725; 426/107, 115, 118, 426/413, 234, 625, 627; 383/104, 122
See application file for complete search history.

(56) References Cited

U.S. PATENT DOCUMENTS

| | | | |
|---|---|---|---|
| 1,331,590 | A | 2/1920 | Shotwell |
| 1,665,576 | A | 4/1928 | Witham |
| 1,707,853 | A | 4/1929 | Haberman |
| 1,765,862 | A | 6/1930 | Claff |
| 1,944,089 | A | 1/1934 | Litchfield |
| 2,030,295 | A | 2/1936 | Hodge |
| 2,041,227 | A | 5/1936 | Chalmers |
| 2,149,872 | A | 3/1939 | Schmidt |
| 2,590,580 | A | 3/1952 | Schiavone |
| 2,617,581 | A | 11/1952 | Smith |
| 2,648,479 | A | 8/1953 | Martin |

(Continued)

FOREIGN PATENT DOCUMENTS

| | | |
|---|---|---|
| DE | 1786047 | 11/1972 |
| DK | 81544 | 12/1956 |

(Continued)

OTHER PUBLICATIONS

International Search Report and Written Opinion mailed Jun. 30, 2011, in Application No. PCT/US2010/048762.

(Continued)

*Primary Examiner* — Quang Van
(74) *Attorney, Agent, or Firm* — Advent, LLP

(57) ABSTRACT

A microwave popcorn package includes a flexible bag construction reinforced with a sidewall construction. The package is such that the flexible bag construction and the sidewall construction are expandable between a collapsed configuration and an expanded configuration. After the package is opened, the sidewall construction provides for a vertically rigid sidewall to provide a stand up bowl for access to the popped popcorn. The flexible bag construction may be fabricated from a generally transparent material so that the contents of the bag are visible when the package is in the expanded configuration.

37 Claims, 25 Drawing Sheets

(56) References Cited

U.S. PATENT DOCUMENTS 2,673,805 A 3/1954 Colman
2,673,806 A 3/1954 Colman
2,740,576 A 4/1956 Franck
2,741,559 A 4/1956 Banowitz
2,815,164 A 12/1957 Painter
2,815,883 A 12/1957 Robins et al.
2,819,976 A 1/1958 Hines
2,852,898 A 9/1958 Berg
2,858,970 A 11/1958 Barnes et al.
2,865,768 A 12/1958 Barnes et al.
3,024,710 A 3/1962 Gastright
3,027,261 A 3/1962 Samara
3,035,754 A 5/1962 Meister
3,052,554 A 9/1962 Colman
3,054,680 A 9/1962 Mennen
3,107,989 A 10/1963 Fesco
3,140,034 A 7/1964 Wyman et al.
3,144,194 A 8/1964 Cartwright
3,220,635 A 11/1965 Kasting et al.
3,286,832 A 11/1966 Pilger
3,293,048 A 12/1966 Kitterman
3,326,097 A 6/1967 Lokey
3,353,327 A 11/1967 Cutler et al.
3,357,152 A 12/1967 Geigel ..... 53/452
3,380,646 A 4/1968 Doyen ..... 383/104
3,425,845 A 2/1969 Dunn
3,519,439 A 7/1970 Dunn
3,556,815 A 1/1971 Fujiwara
3,620,834 A 11/1971 Duffy
3,367,132 A 1/1972 Gray
3,638,784 A 2/1972 Bodolay et al.
3,647,508 A 3/1972 Gorrell
3,671,270 A 6/1972 Jehn
3,721,061 A 3/1973 Bodolay ..... 53/135
3,743,169 A 7/1973 Person ..... 229/31
3,777,447 A 12/1973 Herbine et al.
3,782,976 A 1/1974 Maier et al.
3,835,280 A 9/1974 Gades et al.
3,844,409 A 10/1974 Bodolay et al.
3,851,574 A 12/1974 Katz et al. ..... 426/107
3,873,735 A 3/1975 Chalin et al.
3,873,738 A 3/1975 Zoeller et al. ..... 426/111
3,956,866 A 5/1976 Lattur
3,969,535 A 7/1976 Bourns ..... 426/111
3,970,241 A 7/1976 Hanson
3,973,045 A 8/1976 Brandberg et al. ..... 426/110
4,007,285 A 2/1977 Maier et al. ..... 426/108
4,036,423 A 7/1977 Gordon
4,038,425 A 7/1977 Brandberg et al. ..... 426/107
4,043,098 A 8/1977 Putnam, Jr. et al.
4,051,993 A 10/1977 Castoldi, Jr. ..... 229/22
4,077,853 A 3/1978 Coll-Palagos
4,118,913 A 10/1978 Putnam, Jr. et al.
4,132,811 A 1/1979 Standing et al.
4,136,505 A 1/1979 Putnam, Jr. et al.
4,156,806 A 5/1979 Teich et al.
4,171,605 A 10/1979 Putnam, Jr. et al.
4,184,061 A 1/1980 Suzuki et al.
4,190,757 A 2/1980 Turpin et al.
4,196,331 A 4/1980 Leveckis et al.
4,211,360 A 7/1980 Scott et al. ..... 229/43
4,219,573 A 8/1980 Borek
4,228,945 A 10/1980 Wysocki
4,230,767 A 10/1980 Isaka et al.
4,230,924 A 10/1980 Brastad et al.
4,241,563 A 12/1980 Müller et al.
4,242,378 A 12/1980 Arai
4,258,086 A 3/1981 Beall
4,260,101 A 4/1981 Webinger ..... 229/41
4,264,668 A 4/1981 Balla
4,267,420 A 5/1981 Brastad
4,279,933 A 7/1981 Austin et al.
4,283,427 A 8/1981 Winters et al.
4,288,027 A 9/1981 Peterson ..... 229/43
4,291,520 A 9/1981 Prince et al.
4,292,332 A 9/1981 McHam ..... 426/111
4,316,070 A 2/1982 Prosise et al.
4,324,088 A 4/1982 Yamashita et al.
4,335,291 A 6/1982 Ishino et al.
4,345,133 A 8/1982 Cherney et al.
4,355,757 A 10/1982 Roccaforte
4,383,637 A 5/1983 Pfieffer et al. ..... 229/38
4,386,706 A 6/1983 Korte ..... 206/628
4,389,438 A 6/1983 Ohtsuki et al.
4,398,994 A 8/1983 Beckett
4,448,309 A 5/1984 Roccaforte et al. ..... 206/525
4,450,180 A 5/1984 Watkins
4,453,665 A 6/1984 Roccaforte et al.
4,461,031 A 7/1984 Blamer
4,477,705 A 10/1984 Danley et al. ..... 219/10.55
4,491,220 A 1/1985 Daviss ..... 206/217
4,493,685 A 1/1985 Blamer
4,496,816 A 1/1985 McNamara ..... 219/10.55
4,503,559 A 3/1985 Warnke ..... 383/40
4,509,653 A 4/1985 Corbett ..... 215/231
4,517,045 A 5/1985 Beckett
4,518,651 A 5/1985 Wolfe, Jr.
4,534,505 A 8/1985 Montealegre ..... 229/33
4,548,826 A 10/1985 Watkins ..... 426/394
4,552,614 A 11/1985 Beckett
4,553,010 A 11/1985 Bohrer et al. ..... 219/10.55
4,558,815 A 12/1985 Wischusen, III ..... 229/31
4,571,337 A 2/1986 Cage et al. ..... 426/107
4,574,956 A 3/1986 Kuchenbecker ..... 206/623
4,584,202 A 4/1986 Roccaforte ..... 426/111
4,586,649 A 5/1986 Webinger
4,596,713 A 6/1986 Burdette ..... 426/107
4,610,755 A 9/1986 Beckett
4,612,431 A 9/1986 Brown et al.
4,640,838 A 2/1987 Isakson et al.
4,641,005 A 2/1987 Seiferth
4,661,671 A 4/1987 Maroszek
4,678,882 A 7/1987 Bohrer et al. ..... 219/10.55
4,685,997 A 8/1987 Beckett
4,691,374 A 9/1987 Watkins et al.
4,701,585 A 10/1987 Stewart
4,705,707 A 11/1987 Winter ..... 428/35
4,705,927 A 11/1987 Levendusky et al.
4,713,510 A 12/1987 Quick et al.
4,724,290 A 2/1988 Campbell ..... 219/10.55
4,727,706 A 3/1988 Beer
4,734,288 A 3/1988 Engstrom et al. ..... 426/107
4,735,513 A 4/1988 Watkins et al.
4,738,287 A 4/1988 Klinkel ..... 141/114
4,738,882 A 4/1988 Rayford et al.
4,794,005 A 12/1988 Swiontek
4,797,010 A 1/1989 Coelho
4,804,582 A 2/1989 Noding et al.
4,806,371 A 2/1989 Mendenhall ..... 426/113
4,806,718 A 2/1989 Seaborne et al.
4,808,421 A 2/1989 Mendenhall et al. ..... 426/107
4,808,431 A 2/1989 Rickert ..... 427/8
4,808,780 A 2/1989 Seaborne
4,810,844 A 3/1989 Anderson ..... 219/10.55
4,810,845 A 3/1989 Seaborne
4,818,831 A 4/1989 Seaborne
4,825,025 A 4/1989 Seiferth
4,851,246 A 7/1989 Maxwell et al. ..... 426/107
4,861,958 A 8/1989 Bohrer et al. ..... 219/10.55
4,864,089 A 9/1989 Tighe et al.
4,864,090 A 9/1989 Maxwell et al. ..... 219/10.55
4,870,238 A 9/1989 Hodgetts et al. ..... 219/10.55
4,873,409 A 10/1989 Spruytenburg et al. .... 219/10.55
4,874,620 A 10/1989 Mendenhall et al. ..... 426/113
4,878,765 A 11/1989 Watkins et al.
4,883,936 A 11/1989 Maynard et al.
4,892,744 A 1/1990 Ylvisaker ..... 426/111
4,896,009 A 1/1990 Pawlowski
4,904,487 A 2/1990 LaBaw et al. ..... 426/107
4,904,488 A 2/1990 LaBaw et al.
4,914,266 A 4/1990 Parks et al.
4,915,780 A 4/1990 Beckett
4,927,648 A 5/1990 Ylvisaker ..... 426/234
4,942,050 A 7/1990 Ylvisaker ..... 426/394

(56) References Cited

U.S. PATENT DOCUMENTS 4,942,277 A 7/1990 Narberes ..... 219/10.55
4,943,456 A 7/1990 Pollart et al.
4,948,932 A 8/1990 Clough
4,950,859 A 8/1990 Anderson ..... 219/10.55
4,952,766 A 8/1990 McDonald ..... 219/10.55
4,959,231 A 9/1990 Lakey et al. ..... 426/111
4,959,516 A 9/1990 Tighe et al.
4,963,374 A 10/1990 Brandel et al. ..... 426/107
4,972,058 A 11/1990 Benson et al. ..... 219/10.55
4,973,810 A 11/1990 Brauner
4,982,064 A 1/1991 Hartman et al.
5,003,142 A 3/1991 Fuller
5,008,024 A 4/1991 Watkins
5,011,299 A 4/1991 Black, Jr. et al. ..... 383/126
5,012,068 A * 4/1991 Anderson ..... 219/730
5,038,009 A 8/1991 Babbitt
5,044,777 A * 9/1991 Watkins et al. ..... 383/100
5,045,659 A 9/1991 Wolfe et al. ..... 219/10.55
5,049,072 A 9/1991 Lueschen
5,059,036 A 10/1991 Richison et al. ..... 383/61.2
5,061,500 A 10/1991 Mendenhall ..... 426/118
5,075,119 A 12/1991 Mendenhall ..... 426/113
5,081,330 A 1/1992 Brandberg et al.
5,095,186 A 3/1992 Russell et al.
5,097,107 A * 3/1992 Watkins et al. ..... 219/727
5,153,402 A 10/1992 Quick et al.
5,171,594 A 12/1992 Babbitt ..... 426/107
5,171,950 A 12/1992 Brauner et al. ..... 219/10.55
5,174,658 A * 12/1992 Cook et al. ..... 383/33
5,190,777 A 3/1993 Anderson et al. ..... 426/107
5,195,829 A 3/1993 Watkins et al. ..... 383/100
5,200,590 A 4/1993 Bowen et al. ..... 219/10.55
5,211,975 A 5/1993 Mendenhall et al. ..... 426/107
5,214,257 A 5/1993 Riskey ..... 219/10.55
5,223,288 A 6/1993 Mendenhall et al. ..... 426/107
5,284,666 A 2/1994 Graf ..... 426/242
5,294,764 A 3/1994 Mass ..... 219/727
5,294,765 A * 3/1994 Archibald et al. ..... 219/727
5,298,708 A 3/1994 Babu et al.
5,302,790 A 4/1994 Turpin ..... 219/727
5,306,512 A 4/1994 Blamer ..... 426/107
5,344,661 A 9/1994 Mendenhall et al. ..... 426/107
5,357,086 A 10/1994 Turpin et al. ..... 219/732
5,388,695 A 2/1995 Gilbert ..... 206/423
5,405,663 A 4/1995 Archibald et al. ..... 428/34.3
5,419,100 A 5/1995 Gwiazdon et al. ..... 53/482
5,435,648 A 7/1995 Berkoff ..... 383/90
5,461,216 A 10/1995 McDonald ..... 219/727
5,463,848 A 11/1995 Gwiazdon et al. ..... 53/482
5,468,939 A 11/1995 MacLean, IV ..... 219/727
5,473,142 A 12/1995 Mass ..... 219/727
5,474,383 A 12/1995 Zuege et al. ..... 383/121
5,478,986 A 12/1995 Westerberg ..... 219/411
5,480,372 A 1/1996 Gwiazdon et al. ..... 493/437
5,488,220 A 1/1996 Freerks et al. ..... 219/727
5,496,252 A 3/1996 Gilbert ..... 493/224
5,498,080 A 3/1996 Dalea et al. ..... 383/120
5,507,132 A 4/1996 Gwiazdon et al. ..... 53/469
5,514,854 A 5/1996 Atsaves ..... 219/727
5,650,084 A 7/1997 Bley ..... 219/727
5,679,278 A 10/1997 Cox ..... 219/730
5,690,853 A 11/1997 Jackson et al. ..... 219/727
5,690,979 A 11/1997 Bourns et al. ..... 426/307
5,695,673 A 12/1997 Geissler ..... 219/727
5,753,895 A 5/1998 Olson et al.
5,770,839 A 6/1998 Ruebush et al. ..... 219/727
5,772,331 A 6/1998 Irace et al. ..... 383/90
5,773,801 A 6/1998 Blamer et al. ..... 219/727
5,775,570 A 7/1998 Kim ..... 229/4.5
5,780,824 A 7/1998 Matos ..... 219/727
5,814,382 A 9/1998 Yannuzzi, Jr. ..... 428/34.3
5,834,046 A 11/1998 Turpin et al.
D401,846 S 12/1998 Nguyen ..... D9/305
5,871,790 A 2/1999 Monier et al. ..... 426/107
5,928,550 A 7/1999 Weiss ..... 219/620
5,928,554 A 7/1999 Olson et al.
5,958,482 A 9/1999 Monforton ..... 426/107
5,985,343 A 11/1999 Hasse, Jr. et al. ..... 426/394
5,993,869 A 11/1999 Freeport ..... 426/107
5,994,685 A 11/1999 Jackson et al. ..... 219/727
6,001,209 A 12/1999 Popat et al. ..... 156/249
6,005,234 A 12/1999 Moseley et al. ..... 219/727
6,030,652 A 2/2000 Hanus ..... 426/107
6,046,443 A 4/2000 Ackerman et al. ..... 219/727
6,049,072 A 4/2000 Olson et al. ..... 219/727
6,060,095 A 5/2000 Scrimager ..... 426/107
6,060,096 A * 5/2000 Hanson et al. ..... 426/107
6,066,346 A 5/2000 Hunt et al.
6,077,551 A 6/2000 Scrimager ..... 426/107
6,100,513 A 8/2000 Jackson et al. ..... 219/727
6,126,976 A 10/2000 Hasse, Jr. et al. ..... 426/107
6,137,095 A 10/2000 Kashimoto et al. ..... 219/727
6,149,955 A 11/2000 Wilson ..... 426/112
6,231,903 B1 5/2001 Ji et al. ..... 426/107
6,254,907 B1 7/2001 Galomb ..... 426/115
6,259,079 B1 7/2001 Ji et al. ..... 219/727
6,320,172 B1 11/2001 Watkins ..... 219/725
D453,679 S 2/2002 Blackburn ..... D9/305
6,350,974 B1 2/2002 Manzano et al. ..... 219/735
6,394,265 B1 5/2002 Tsao ..... 206/217
6,396,036 B1 5/2002 Hanson
6,410,065 B1 6/2002 Nottingham et al.
6,431,415 B1 8/2002 Schreiber ..... 222/460
6,586,715 B2 7/2003 Watkins ..... 219/725
6,644,540 B2 11/2003 Jamitzky et al. ..... 229/120.11
6,651,947 B1 11/2003 Price ..... 248/311.2
6,660,983 B2 12/2003 Monforton et al. ..... 219/727
D486,388 S 2/2004 Rauen ..... D9/305
6,733,807 B2 5/2004 Martuch et al. ..... 426/107
6,752,071 B1 6/2004 Snyder ..... 99/323.5
6,872,923 B2 3/2005 Cretors et al. ..... 219/494
6,875,969 B2 4/2005 Lee ..... 219/707
6,884,978 B2 4/2005 Monforton et al. ..... 219/727
6,906,299 B2 6/2005 Watkins ..... 219/725
6,960,748 B2 11/2005 Baker ..... 219/725
7,022,359 B2 4/2006 Gibernau ..... 426/107
7,067,781 B2 6/2006 Trochlil ..... 219/730
7,086,545 B2 8/2006 Mannion et al. ..... 211/181.1
D598,784 S 8/2009 Anderson et al. ..... D9/708
D617,654 S 6/2010 Tawinsook ..... D9/702
D639,181 S 6/2011 Woodfield ..... D9/705
D671,012 S 11/2012 France et al. ..... D9/702
2001/0033883 A1 10/2001 Boody ..... 426/120
2002/0043532 A1 4/2002 Watkins ..... 219/725
2002/0088730 A1 * 7/2002 Galomb ..... 206/459.5
2002/0100755 A1 8/2002 Peterson ..... 219/727
2002/0106427 A1 8/2002 Martuch et al. ..... 426/107
2002/0125306 A1 9/2002 Jamitzky et al. ..... 229/120.11
2002/0127306 A1 9/2002 Schmidt et al. ..... 426/107
2002/0145295 A1 10/2002 Frank et al. ..... 294/31.2
2002/0182291 A1 12/2002 Renini et al. ..... 426/107
2003/0012853 A1 1/2003 Jensen et al. ..... 426/107
2003/0044492 A1 3/2003 Knigge et al. ..... 426/124
2003/0049354 A1 3/2003 Murray
2003/0080118 A1 5/2003 Hanson ..... 219/730
2003/0106899 A1 6/2003 Langen ..... 220/912
2003/0194472 A1 10/2003 Jensen et al. ..... 426/107
2004/0013773 A1 1/2004 Duran Vila et al. ..... 426/107
2004/0031790 A1 2/2004 Kim ..... 219/727
2004/0089656 A1 5/2004 Watkins ..... 219/759
2004/0096550 A1 5/2004 Schilmoeller et al.
2004/0104222 A1 6/2004 Lee ..... 219/707
2004/0105917 A1 6/2004 Mannion et al. ..... 426/110
2004/0219332 A1 11/2004 Dean et al. ..... 428/131
2004/0238535 A1 * 12/2004 Mast ..... 219/730
2004/0238538 A1 12/2004 Cosentino ..... 220/23.83
2004/0245240 A1 12/2004 Cretors et al. ..... 219/494
2005/0040174 A1 2/2005 Costello et al. ..... 220/670
2005/0045624 A1 3/2005 Groll ..... 219/621
2005/0067411 A1 * 3/2005 Monforton et al. ..... 219/727
2005/0077291 A1 4/2005 Baker ..... 219/725
2005/0092623 A1 5/2005 Cuomo ..... 206/162
2005/0121444 A1 6/2005 Trochlil ..... 219/730
2005/0199620 A1 9/2005 Fish ..... 219/730

(56) References Cited

U.S. PATENT DOCUMENTS

| | | | | |
|---|---|---|---|---|
| 2005/0230459 | A1 | 10/2005 | Johnson et al. | 229/80 |
| 2005/0276885 | A1 | 12/2005 | Bennett | |
| 2006/0018999 | A1 | 1/2006 | Risch | 426/107 |
| 2006/0062956 | A1 | 3/2006 | Chandaria et al. | 428/43 |
| 2006/0078655 | A1 | 4/2006 | Plank et al. | 426/107 |
| 2006/0127549 | A1 | 6/2006 | Murray | |
| 2006/0131303 | A1 | 6/2006 | Trochlil | 219/730 |
| 2006/0191985 | A1 | 8/2006 | Norcom | |
| 2006/0204622 | A1 | 9/2006 | Renini et al. | 426/107 |
| 2006/0231552 | A1 | 10/2006 | Caya | 219/727 |
| 2006/0261060 | A1 | 11/2006 | Baez | 220/4.21 |
| 2006/0289513 | A1 | 12/2006 | Raughley | 219/729 |
| 2006/0289524 | A1 | 12/2006 | Ludwig et al. | 219/734 |
| 2007/0284369 | A1 | 12/2007 | Murray | |
| 2008/0166457 | A1 | 7/2008 | Gorman et al. | 426/107 |
| 2008/0178744 | A1 | 7/2008 | Hill | 99/323.5 |
| 2011/0070391 | A1 | 3/2011 | Cotton | 428/43 |

FOREIGN PATENT DOCUMENTS

| | | | | |
|---|---|---|---|---|
| EP | 0 823 388 | A1 | 2/1998 | B65D 81/34 |
| JP | 2005-516853 | A | 6/2005 | A47J 27/00 |
| RU | 2304075 | | 4/2005 | |
| WO | 2004048225 | | 6/2004 | |

OTHER PUBLICATIONS

International Search Report and Written Opinion mailed May 22, 2008 in Application No. PCT/US08/50391.

Accessed at http://www.emeraldnuts.com/ Easy Open Pull String, on Dec. 4, 2009; 1 pg.

European Search Report and Written Opinion mailed Apr. 29, 2010 in Application No. 08713616.4.

U.S. Official Action mailed Feb. 23, 2012, in U.S. Appl. No. 11/970,349.

U.S. Official Action mailed Jan. 14, 2013, in U.S. Appl. No. 12/880,938.

U.S. Official Action mailed Apr. 23, 2012, in U.S. Appl. No. 29/394,183.

U.S. Official Action mailed Jun. 1, 2012, in U.S. Appl. No. 29/394,187.

U.S. Official Action mailed Jun. 15, 2012, in U.S. Appl. No. 11/970,349.

U.S. Official Action mailed Jun. 26, 2012, in U.S. Appl. No. 12/953,123.

U.S. Official Action mailed Jul. 18, 2012, in U.S. Appl. No. 29/394,193.

U.S. Official Action mailed Nov. 6, 2012, in U.S. Appl. No. 12/953,123.

* cited by examiner

MICROWAVE POPCORN PACKAGE

RELATED APPLICATIONS

The present application is a continuation of U.S. patent application Ser. No. 11/970,349 filed on Jan. 7, 2008, which claims priority under 35 U.S.C. §119(e) to U.S. Provisional Patent Application Ser. No. 60/879,142 filed on Jan. 8, 2007. U.S. patent application Ser. No. 11/970,349 and U.S. Provisional Patent Application Ser. No. 60/879,142 are hereby incorporated by reference in their entireties.

BACKGROUND

Microwave popcorn popping bag constructions in current commercial use employ multiply paper bags in which inner and outer flexible paper sheets or plies are laminated to one another, typically with a microwave interactive construction (sometimes referred to as a microwave susceptor) encapsulated between the two flexible paper sheets.

A common feature of such constructions is that they are generally made from relatively flexible paper materials. Typically, when a two-ply arrangement is used, the inner ply is a greaseproof or grease-resistant paper. For example, the inner ply may be a flexible paper material having a basis weight no greater than about 25 lbs. per ream, typically within the range of 20-25 lbs. per ream. In such instances, the inner ply can be fabricated from a fluorochemical treated paper or other treated paper having a grease resisting characteristic. The outer ply is typically a 21 lb. bleached Kraft paper.

Using these common two-ply construction techniques, the resulting microwave popcorn container constructions can be provided in a bag form that is: (a) collapsed and folded when stored before use; (b) can be unfolded and expanded during a popping operation, when a popcorn charge therein is exposed to microwave energy in a microwave oven; and, (c) can be collapsed for disposal once used. Since the materials are constructed such that they can be collapsed and folded, the arrangements can be easily manufactured, filled, shipped, and stored.

When the popping operation is completed, the bag is opened and the contents emptied into a container such as a bowl for consumption. The bag may then be collapsed for disposal. When a container is not available, the consumer may instead reach into the bag to obtain the contents.

SUMMARY

Microwave popcorn packages are disclosed. In implementations, the microwave popcorn packages comprise a sidewall construction and a flexible bag construction. The sidewall construction is formed of a vertically rigid material and configured to be expandable between a collapsed configuration and an expanded configuration. The flexible bag construction includes a portion that is secured to the interior of the sidewall construction, and is also configured to be expandable between the collapsed configuration and the expanded configuration. In the expanded configuration, the flexible bag construction and the sidewall construction form a container having vertically rigid sidewalls. In one or more embodiments, the flexible bag construction may be generally transparent (e.g., transparent or translucent to visible light) so that contents of the bag may be visible during popping, after popping in the expanded configuration, and so on.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The detailed description is described with reference to the accompanying figures. In the figures, the use of the same reference numbers in different instances in the description and the figures may indicate similar or identical items.

DETAILED DESCRIPTION

Overview

Figure 1A:
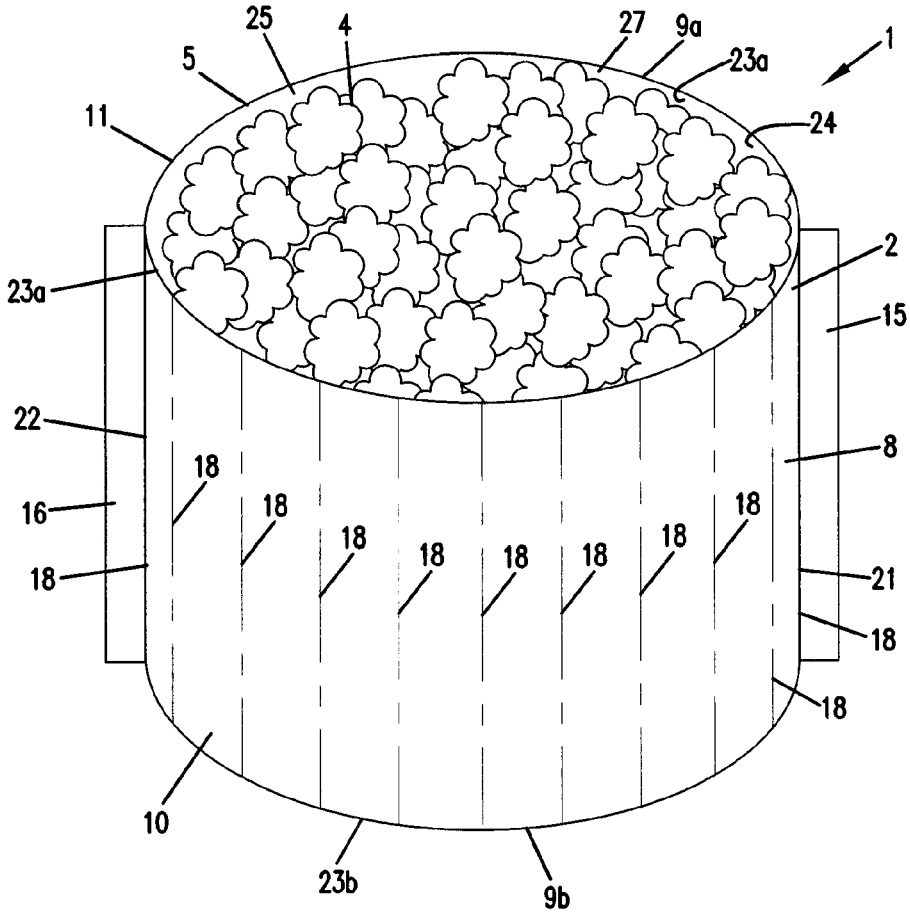
FIGS. 1A and 1B are schematic, perspective views illustrating example microwave popcorn packages according to the present disclosure after popcorn popping in a microwave oven and after package opening.

An example microwave popcorn package is described. The microwave popcorn package includes a sidewall construction and a flexible bag construction. Together, the sidewall construction and the flexible bag construction provide for an arrangement that: (a) contains unpopped microwaveable popcorn in a convenient container; (b) can expand upon exposure to microwave energy as the popcorn pops; and (c) can be stood up and used as a rigid walled bowl, for access to the popped popcorn.

The microwave popcorn package generally has a collapsed configuration and an expanded configuration. The collapsed configuration is the configuration of the popcorn package prior to exposure to microwave energy in a microwave oven, to pop a contained, unpopped, microwaveable popcorn charge. The microwave popcorn package is comprised of microwave transparent materials, except for a microwave interactive construction used as described herein. This structure provides for efficient utilization of microwave energy to cause microwave popcorn popping.

The sidewall construction provides for a vertically rigid sidewall in the eventual bowl configuration. In general the sidewalls are "vertically rigid" meaning the sidewalls are resistant to collapse when stood vertically during normal use. However the sidewalls are flexible and can be deformed from a flat to an expanded generally convex configuration, as described. The sidewall construction may be fabricated of a semi-rigid material such as a paperboard material, a paper material, a film material, a plastic material, or the like.

The sidewall construction comprises first and second panels. The panels may be formed from a single piece, or can be two pieces adhered to one another. Each of the panels may have opposite side ends or edge portions, and each may include a plurality of fold lines (e.g., score lines, crease lines, etc.) extending generally parallel to the side edge portions. The fold lines facilitate flexing of the sidewall construction into a generally convex arrangement, such as, for example a curved (e.g., ring) arrangement, a faceted (e.g., polygonal) arrangement, an irregular curved arrangement, and so on) when the microwave popcorn package is in the expanded configuration. The first and second panels are generally rectangular, although other shapes can be used.

The flexible bag construction is positioned between, and may be secured to the panels of, the sidewall construction. Thus, the bag construction is positioned internally of (e.g., inside) the sidewall construction. In examples, the flexible bag construction is surrounded by, or circumscribed by, the sidewall configuration. Other configurations are possible.

The flexible bag construction includes a central portion in which an unpopped popcorn charge is positioned prior to popping. A microwave interactive construction is positioned in thermoconductive relation to the central portion so the heat from the microwave interactive construction is transferred to the vicinity of the unpopped popcorn during a microwave popping operation.

The flexible bag construction may comprise a paper construction, a film construction such as a polyester film (e.g., a biaxially-oriented polyethylene terephthalate [PET]) construction, and so on, and may be single-ply or multiple (e.g., double) ply. In one example, the flexible bag construction may be generally transparent (e.g., transparent or translucent) to allow the contents (e.g., popped popcorn) of the package to be viewed.

In one or more implementations, the flexible bag construction has first and second side panels, a bottom, and a top. In implementations, the bottom of the flexible bag construction may comprise a base gusset. The flexible bag construction is positioned such that a base gusset thereof is located inside of the sidewall construction. In other implementations, the bottom of the flexible bag construction may comprise a collapsed flat bottom that is folded over the sidewall construction. Other bottom configurations are possible. The bottom (e.g., the base gusset, collapsed flat bottom, etc.) when expanded, forms a bottom of the bowl, inside the upwardly standing sidewall construction. Thus, the bottom of the bowl is not rigid. Rather, the bottom is a flexible bag material.

A top of the flexible bag construction may be removed to provide access to the contents of the flexible bag construction when the microwave popcorn package is in the expanded configuration. For example, the top may include a top portion of the flexible bag construction that may project outwardly from inside of the sidewall construction. The top may also include a top gusset that is directed inwardly. The top portion or top gusset is removed when the package is opened for use. The top of the flexible bag construction may further be configured to vent during a popping operation, thereby relieving pressure from the flexible bag construction during and after popping. For example, in one or more implementations, the flexible bag construction may be configured to vent near the end of the popping operation. In this manner, the flexible bag construction may be inflated during popping so that visibility of the popping popcorn is enhanced.

The flexible bag construction may thus be characterized as having: a first collapsed configuration in which the bottom (e.g., a base gusset, a collapsed flat bottom, etc.) is (and, if present, a portion of the first and second side panels are) positioned folded collapsed and positioned inside or folded over the sidewall construction; and, as having a second expanded configuration in which the bottom is expanded when inside of the bowl or ring configuration of the sidewall construction, to form a bowl having a vertically rigid sidewall and a flexible bottom.

The flexible bag construction may be folded from a single (e.g., one-piece) package blank. The terms "single" and "one-piece" in this context are meant to refer to a package blank that is a single unit. It may comprise various layers secured to one another. The package blank may comprise a single-ply or multi-ply construction.

Example Microwave Popcorn Packages

Example microwave popcorn packages are now described. In the figures described herein below, some relative material thicknesses and component sizes may be shown exaggerated, to facilitate an understanding of the disclosure. Additionally, as used herein, the terms "top" and "bottom" are used to refer to components, with reference to relative location after the package is configured in an expanded configuration and is stood up, for normal use. Thus, the terms "top" and "bottom"

may be used to identify components even when those components are in the collapsed configuration, but with reference to eventual relative locations once the package is expanded and positioned stood on its bottom or base, for normal use.

Figure 1B:
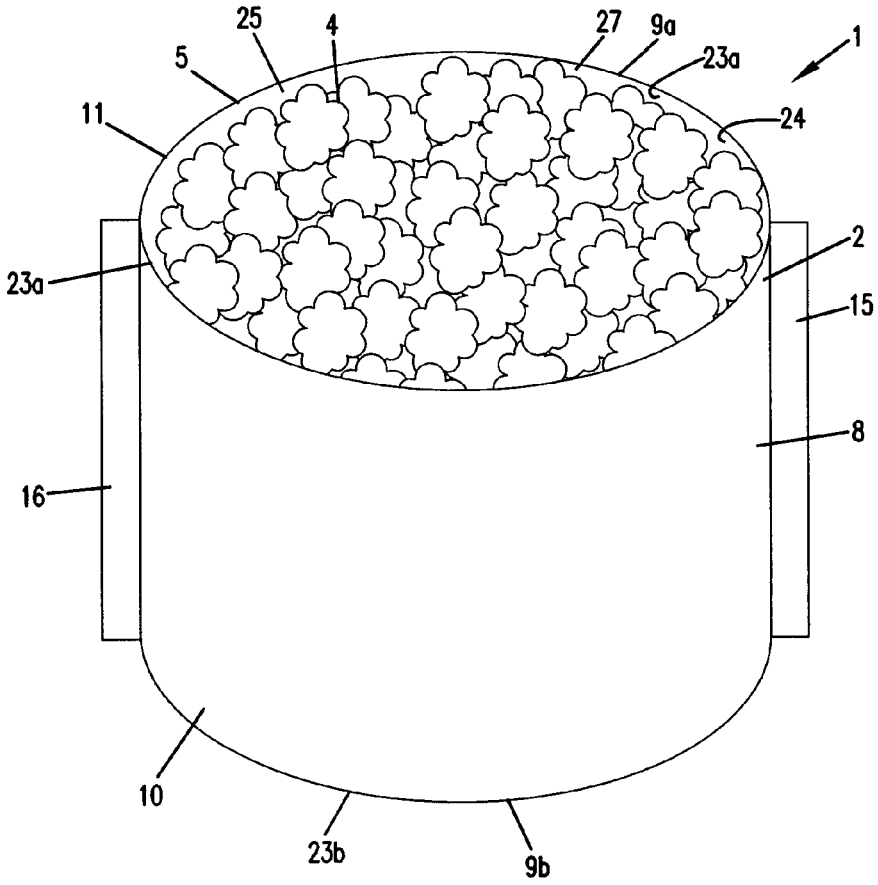

FIGS. 1A and 1B depict example microwave popcorn packages 1 after: (a) popping microwave poppable popcorn upon exposure of microwave energy in a microwave oven to convert the microwave popcorn package from a collapsed configuration to an expanded configuration; and (b) opening the package 1 and positioning for normal use for access to popped popcorn therein. In FIGS. 1A and 1B, a portion of package 1 is depicted. The portion includes an open or expanded package bowl 2 that remains to be stood upright, for normal use, after a top portion is removed to open the package 1 and provide access to the package contents (e.g., popped popcorn) 4 through open top 5.

The microwave popcorn package 1 includes a sidewall construction 8. In general, the sidewall construction 8 is vertically rigid. By the term "vertically rigid" and variants thereof, in this context, it is meant that the sidewall construction 8 is resistant to collapse when stood up in the orientation shown in FIGS. 1A and 1B, in the vertical direction. The term "vertically rigid" is not meant to suggest the microwave popcorn package 1 cannot be collapsed, but rather that the package 1 is resistant to collapse under ordinary use conditions, and is more resistant to collapse than would be a flexible paper bag construction alone.

The example sidewall construction 8 depicted defines the bowl 2 as having an upper or top edge 9*a* and lower or bottom edge 9*b*, and includes first and second panels 10, 11 extending between side ends 15, 16. The first and second panels 10, 11 may comprise separate pieces of material secured to one another, or, the panels 10, 11 may be folded from a single piece of material. For the particular sidewall construction 8 shown, each of the first and second panels 10 and 11 may be fabricated of a vertically rigid material that is adapted to be curved or configured from a flat or collapsed configuration into an expanded configuration having a generally a generally convex arrangement, such as, for example a curved (e.g., ring) arrangement, a faceted (e.g., polygonal) arrangement, an irregular curved arrangement, and so on) to define the open top 5 depicted in FIGS. 1A and 1B.

In FIG. 1A, the first and second panels 10, 11 illustrated may be fabricated from a semi-rigid material such as a paperboard material, a paper material, a film material, a plastic material, or the like. The use of a semi-rigid material allows the panels 10, 11 to have substantial vertical rigidity in the direction from top edge 23*a* to bottom edge 23*b*. Thus, the sidewall construction 8 of FIG. 1A may operate as, and define, a sidewall of a bowl configuration 2, when stood up as shown in FIG. 1.

In implementations, the first and second panels 10, 11 may be fabricated of a paper or paperboard material. Herein, the term "paperboard" is meant to include various materials, including various forms of fiber board and cardboard provided the material selected is sufficiently vertically rigid to resist vertical collapse under conditions of normal use, when positioned as shown. A variety of paper and paperboard materials may be used provided the materials have sufficient vertical rigidity to function as an end container. For instance, the material used in fabrication of the first and second panels 10, 11 may comprise a paperboard material of at least 8 points, for example, within the range of 8-15 points (e.g., 10-12 points). Typically, 1 point is equal to 0.001 inch or 0.025 mm thickness. Paper and/or paperboard materials useable may have a variety of weights. For instance, in example implementations, a paper material useable may have a weight of as little as 45-50 lbs. per ream or less provided the paper material provides sufficient vertical rigidity as discussed above. In other implementations, paperboard materials useable include those having a weight of 75 lbs. per ream or more. In such implementations, paperboard materials used may have a weight of at least 85 lbs. per ream, for example 90 lbs. per ream or more. However, lightweight paper or paperboard materials having weights less than 75 lbs. per ream may be used. As noted, other materials such as film materials, plastic materials, and so on, may also be used to form first and second panels 10, 11.

As shown in FIG. 1A, the vertically rigid material of first panel 10 may be modified by fold lines (e.g., creases or scores) 18 to allow for, and to facilitate, curvature. The second panel 11 may include analogous fold lines (e.g., creases or scores), not shown. The fold lines 18 may extend across the sidewall construction 8, and may help the first and second panels 10, 11 to be flexed into a generally convex configuration analogous to the one shown. Fold lines 21, 22 adjacent to side ends 15, 16, respectively, facilitate flexing of first panel 10 at these locations. The second panel 11 may include analogous fold lines to fold lines 21, 22, shown.

The fold lines 18 may generally be viewed as vertical scores or creases, since they extend vertically when the sidewall construction 8 is in its expanded, upright, position as shown in FIG. 1A. Herein, when the fold lines extend completely between the top edge 9*a* and the bottom edge 9*b*, the fold lines 18, 21, 22 may be characterized as "vertically complete." When the fold lines 18, 21, 22 are continuous and not segmented, the lines may be characterized as "continuous" or by variants thereof. In general terms, the fold lines 18 may be oriented to be generally parallel to the side ends 15, 16.

In general, as shown in FIG. 1A, the fold lines 18, 21, 22 are not cuts through or part-way through the first and second panels 10, 11, although such is possible. Rather, the fold lines 18, 21, 22 shown are package creases or scores of the type used on paperboard packaging containers, to create separate panels and tabs. Such creases or scores are generally formed by creaser equipment that compresses the material along a defined line creating a region of weakness that can be easily folded or manipulated. Thus, the fold lines 18, 21, 22, can be formed with standard packaging equipment for paperboard or cardboard containers.

In the example shown, the first and second panels 10, 11 are generally identical to one another, positioned as mirror images in the microwave popcorn package 1. Each defines an upper or top edge 23*a* and an opposite lower or bottom edge 23*b*, corresponding to top and bottom edges 9*a*, 9*b*, respectively. The fold lines 18, 21, 22 provide for weakness in portions or segments of the first and second panels 10, 11 to allow easy adaptation from flat (e.g., non-expanded) to the expanded form depicted in FIG. 1A. The fold lines 18, 21, 22 may be continuous or discontinuous (segmented). The number of fold lines 18 between side ends 15, 16 is a matter of choice, depending upon the amount of curvature desired. For example, fold lines between opposite edges 23*a*, 23*b* may be spaced at intervals ranging from 15 to 35 mm (e.g., at 19 to 30 mm intervals).

In FIG. 1B, the first and second panels 10, 11 are fabricated from a paper material. In implementations, the paper material may be of sufficient weight (e.g., gauge) to allow the panels 10, 11 to have substantial vertical rigidity in the direction from top edge 23*a* to bottom edge 23*b*. Thus, like the sidewall construction 8 shown in FIG. 1A, the sidewall construction 8 of FIG. 1B may operate as, and define, a sidewall of a bowl configuration 2, when stood up as shown. In one example, the material used in fabrication of first and second panels 10, 11 may comprise a paper material having a weight of at least 60 lbs. per ream. However, paper materials having weights lighter than 60 lbs. per ream may also be used. Additionally, other materials such film materials, plastic materials, and the like, may be used.

In the example shown in FIG. 1B, the first and second panels 10, 11 are again generally identical to one another, positioned as mirror images in the microwave popcorn package 1. However, the vertically rigid material of the first and second panels 10, 11 is sufficiently flexible in the horizontal direction to allow easy adaptation from flat (e.g., non-expanded) to the expanded form depicted. Thus, the vertically rigid material of the panels 10, 11 is not modified by fold lines. In FIG. 1B, as in FIG. 1A, each panel 10, 11 defines an upper or top edge 23*a* and an opposite lower or bottom edge 23*b*, corresponding to top and bottom edges 9*a*, 9*b*, respectively.

FIGS. 1A and 1B are schematic. For the examples shown, the first and second panels 10, 11, are joined at side ends (e.g., tabs) 15, 16 with portions of the flexible bag construction 25 (in particular, portions of side seams) captured therebetween. The amount of curvature obtained in the first and second panels 10, 11 may depend upon such factors as: the thickness of the first and second panels 10, 11; the length of the first and second panels 10, 11 between the side ends 15, 16; the presence, number, configuration, and spacing of fold lines 18; and the extent to which the package is manipulated into the generally convex construction by the consumer.

In general, for microwave popcorn package 1, the sidewall construction 8 defines an interior 24 in which the flexible bag construction 25 is received. The contents 4 are contained within an interior 27 of the flexible bag construction 25. The flexible bag construction 25 may comprise a paper construction, a film construction such as a polyester film (e.g., a biaxially-oriented polyethylene terephthalate [PET]) construction, and so on, and may be single-ply or multiple (e.g., two) ply. In one or more implementations, the flexible bag construction may be generally transparent to allow the contents (e.g., popped popcorn) 4 of the package 1 to be viewed. As used herein, the flexible bag construction 25 may be "generally transparent" if the contents 4 of the bag 25 are visible through the bag 25. Thus, the flexible bag construction 25 may be generally transparent if the bag 25 is completely transparent, translucent, transparent or translucent with opaque regions, transparent or translucent with printed indicia, tinted, and so on.

The flexible bag construction 25 provides an enclosure for the microwave poppable popcorn charge during storage of the package 1 and popping; and a bottom for the resulting bowl arrangement. Thus, the flexible bag construction 25 has an expanded configuration and a collapsed configuration. The flexible bag construction 25 occupies a collapsed configuration prior to popping, and the expanded configuration after popping.

Referring now to FIGS. 2A, 2B, 3A, and 3B, example microwave popcorn packages 1 are depicted in a collapsed form, e.g., as the packages 1 would appear before a popping operation, for example, after the package 1 has been placed in (e.g., on the floor or turntable of) a microwave oven for a popping operation, and before the top of the flexible bag construction 25 has been removed to open the package 1 as discussed in reference to FIGS. 6A and 6B below.

Figure 3A:
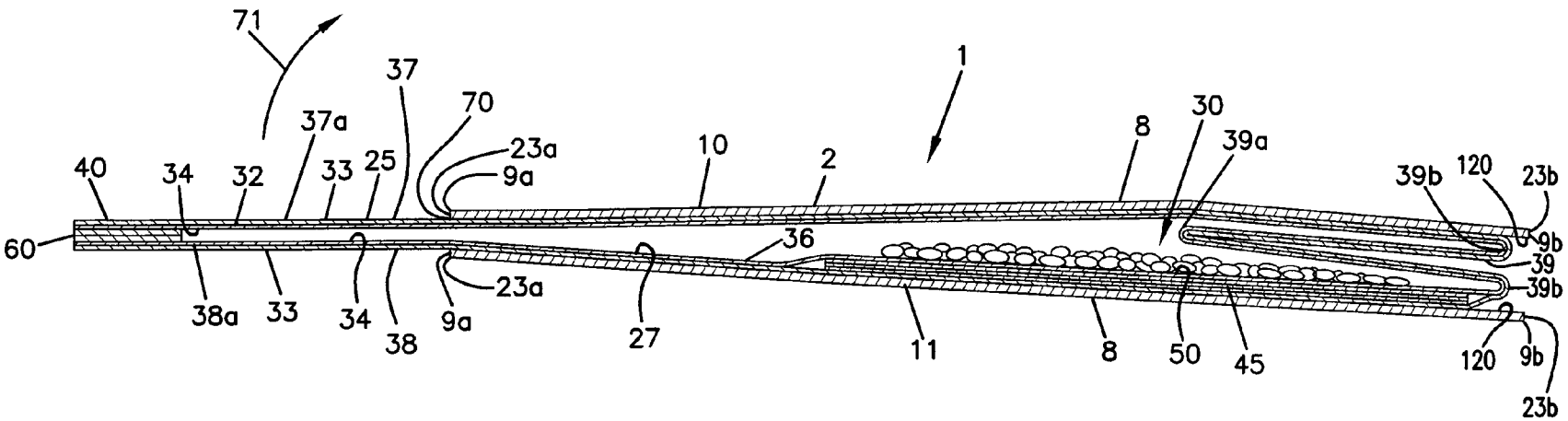
FIGS. 3A and 3B are cross-sectional views of the microwave popcorn packages shown in FIGS. 2A and 2B, respectively, taken generally along line 3A-3A and 3B-3B thereof.
Figure 3B:
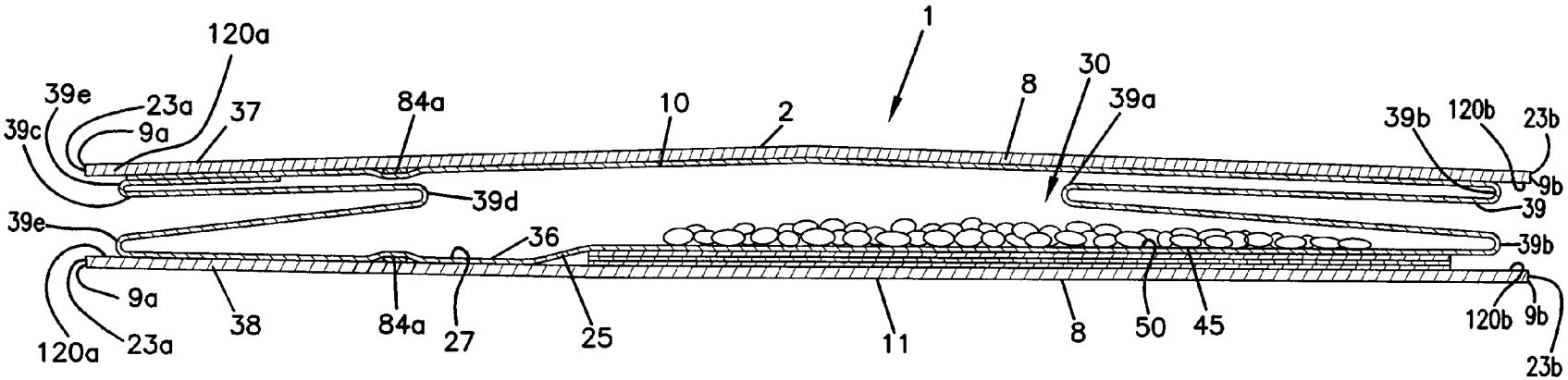

In FIGS. 3A and 3B, the sidewall construction 8 is shown in the collapsed form including first and second panels 10, 11 defining top and bottom edges 23*a* and 23*b*, respectively. The internal flexible bag construction 25 is viewable in a collapsed form and defining interior 27 in which an unpopped popcorn charge 30 is positioned. The unpopped popcorn charge 30 may include various components or additives such as fat/oil, salt, seasonings, nutrients, and so on, as are commonly used for microwave popcorn products. In one or more implementations, various components used as part of the charge 30, for example a fat, oil or other components, can be included within an internal pouch structure, for example the type described in the U.S. patent application having Ser. No. 10/299,537, incorporated herein by reference.

Referring to FIG. 3A, an example flexible bag construction 25 is shown that comprises a two-ply bag arrangement 32 having an outer ply 33 and an inner ply 34. The flexible bag construction 25 may be folded from a single (e.g., one-piece panel) blank 36 to define first and second opposite sides 37 and 38, with a bottom comprised of a base gusset 39 positioned there between. The base gusset 39 is "inwardly directed." By this, it is meant that a center fold line 39*a* of the gusset 39 is directed inwardly between sides 37, 38, from edges 39*b*.

A portion of side 37 may be secured to the first panel 10 with an end portion 37*a* of side 37 projecting outwardly from between the first and second panels 10, 11 beyond the top edge 9*a*. By use of the term "beyond" in this context, it is meant that the extension is out from between the first and second panels 10, 11 in a direction from edge 9*a*. Similarly, side 38 is secured to second panel 11 with a portion 38*a* projecting outwardly from between the first and second panels 10, 11 beyond the top edge 9*a*.

Extension 40 of the flexible bag construction 25, which comprises the portions 37*a*, 38*a* extending outwardly from between the first and second panels 10, 11, beyond the top edges 9*a*, is configured to be torn from a remainder 26 of the package 1 during an opening step, as discussed herein below.

Figure 2A:
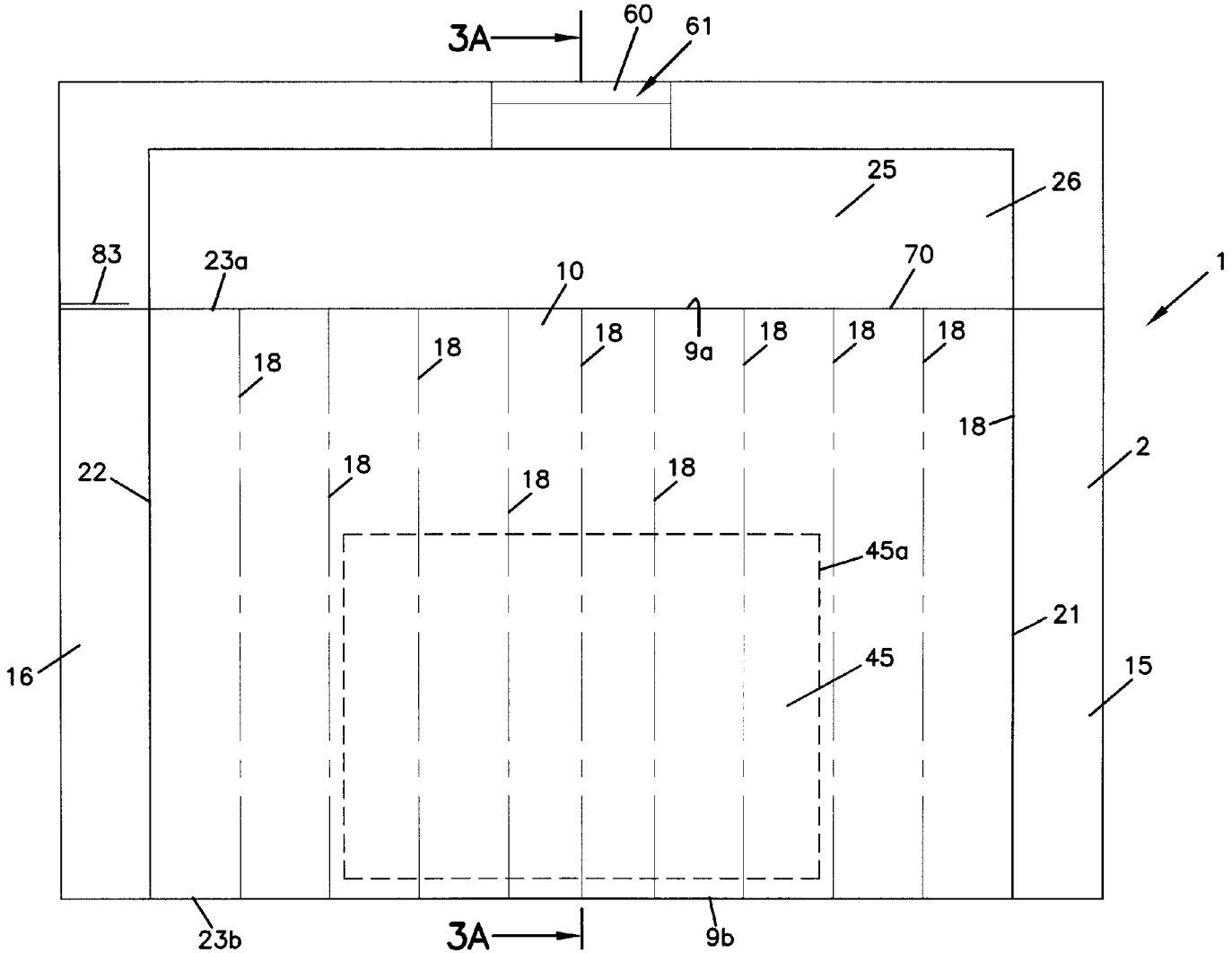
FIGS. 2A and 2B are schematic, plan views of example microwave popcorn packages according to the present disclosure, prior to microwave popcorn popping.

In FIG. 3A, microwave interactive construction (e.g., a microwave susceptor) 45 is shown positioned in thermoconductive relation to a central region 50 of the flexible bag construction 25 adjacent to the second panel 11. In FIG. 2A, phantom lines 45*a* indicate the approximate position of microwave interactive construction 45. In the implementation shown, the microwave interactive construction 45 may be positioned between the plies 33, 34 of the flexible bag construction 25. However, other configurations are possible. For example, the microwave interactive construction may be positioned between the outer ply 34 and the second panel 11, on the outer surface of the second panel 11 (e.g., covered by a patch), and so on. Herein, the term "microwave interactive construction" is meant to refer to a construction which, upon exposure to microwave energy in a microwave oven, generates heat. A variety of microwave interactive constructions may be used, example ones comprising a metalized (e.g., aluminized) polyester film.

The unpopped popcorn charge 30 is shown positioned within interior 27 of the flexible bag construction 25 in the central region 50, over, and in thermoconductive contact with, microwave interactive construction 45. When the arrangement of FIG. 3A is placed in a microwave oven in the general orientation shown, and is exposed to an adequate level of microwave energy, heat and generated steam or vapor will cause expansion of the flexible bag construction 25 and thus the package 1. During popping, the flexible bag construction 25 may vent along top seam 60. As shown, top seam 60 may be constructed to have at least a central portion 61 (FIG. 2A) thereof that comprises a heat releasable material to allow and facilitate venting. In addition, as the flexible bag construction 25 expands during popping, the first and second panels 10, 11 are pushed away from one another and the base gusset 39 is opened.

Referring to FIG. 3B, a flexible bag construction 25 is shown that comprises a single-ply bag arrangement 32*a* having ply 33*a*. Like the flexible bag construction 25 of FIG. 3A, the flexible bag construction 25 shown in FIG. 3B may be folded from a single (e.g., one-piece) panel blank 36. Folding of the blank 36 defines first and second opposite sides 37 and 38, with a base gusset 39 and a top gusset 39*c* positioned there between. The bottom and top gussets 39 and 39*c* may be longitudinal gussets that are "inwardly directed" so that center fold lines 39*a*, 39*c* of the gussets 39, 39*c* are directed inwardly between sides 37, 38, from edges 39*b*, 39*e*, respectively. In one or more examples, the base gusset 39 may be larger (e.g., deeper) than the top gusset 39*c* since the base gusset 39 is configured to form the bottom of the bowl structure, while the top gusset 39*c* is configured to be removed following popping. For example, the base gusset 39 may be a 4-inch gusset while the top gusset may be a 3-inch gusset. Other configurations are possible.

Figure 2B:
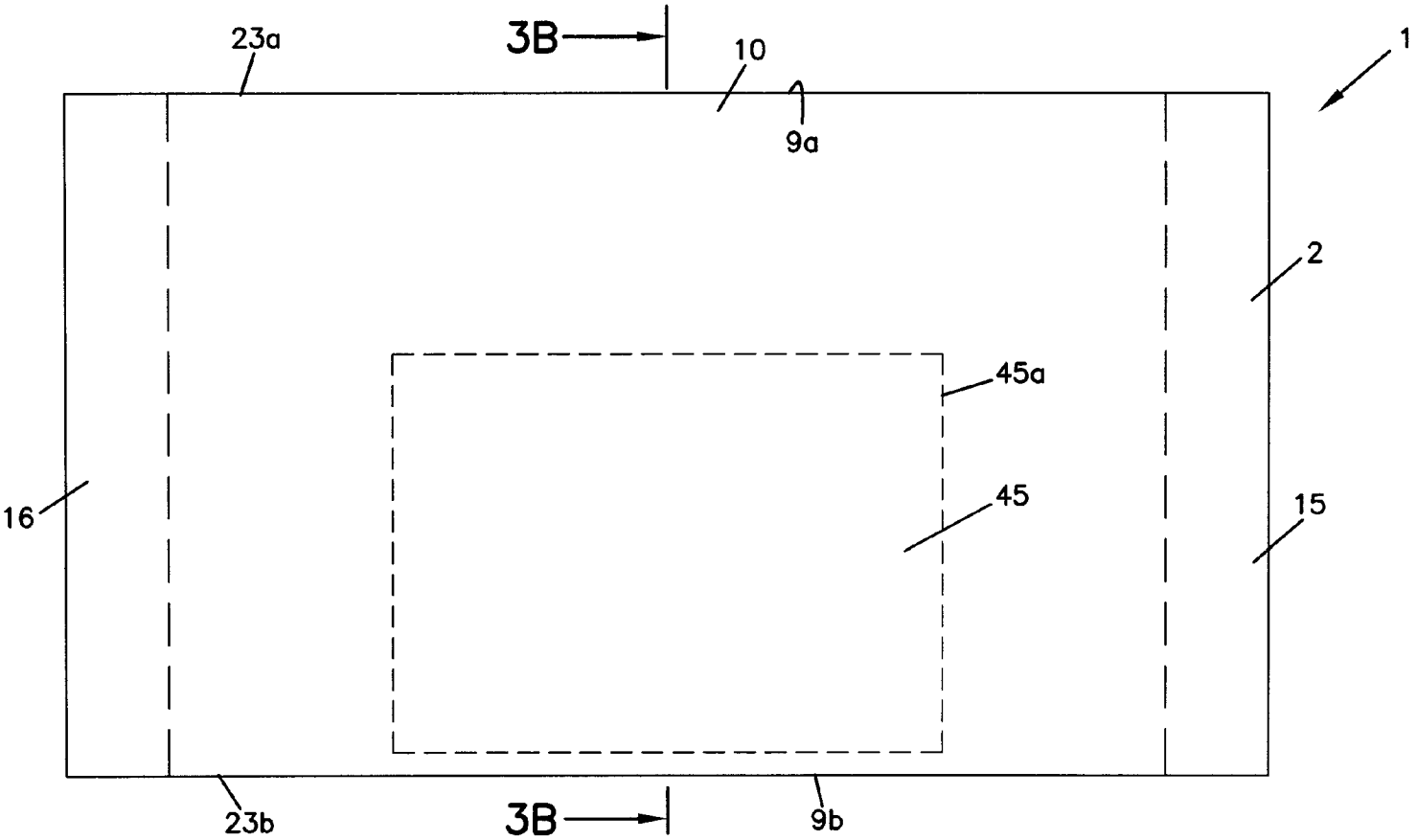

In FIG. 3B, the microwave interactive construction 45 is shown positioned in thermoconductive relation to a central region 50 of the flexible bag construction 25. In FIG. 2B, phantom lines 45*a* indicate the approximate position of microwave interactive construction 45 adjacent to the second panel. In one or more implementations, the microwave interactive construction 45 is affixed (e.g., adhered) directly to ply 33*a*. The second panel 11 is then adhered to the ply 33*a* over the microwave interactive construction 45. In other implementations, the microwave interactive construction 45 may be affixed to the second panel 11 so that the second panel 11 and microwave interactive construction 45 are affixed to the ply 33*a*. A paper insulator may be provided between the microwave interactive construction 45 and the ply 33*a* to limit the heat applied to the ply 33*a* by the microwave interactive construction 45 during the popping operation. The paper insulator may be affixed to the ply 33*a*, the microwave interactive construction 45, the second panel 11, combinations thereof, and so on. In one or more further implementations, the microwave interactive construction 45 may be applied to the outer surface of the second panel 11 and covered by a paper insulator.

In the example illustrated in FIGS. 2B and 3B, the microwave interactive construction 45 may comprise a low optical density microwave susceptor, a patterned microwave susceptor, and so on. Herein, the terms "low optical density microwave susceptor" and "patterned microwave susceptor" are meant to refer to constructions, which, upon exposure to microwave energy in a microwave oven, generate an amount of heat that is sufficient to provide popping, but do not cause excessive damage (e.g., melting, softening, scorching) to the adjacent portions of the flexible bag construction 25. For instance, in implementations where the flexible bag construction 25 is formed of a polyester film such as PET, the microwave interactive construction 45 may be configured so that the temperature of the ply 33*a* adjacent to the microwave interactive construction 45 does not exceed a predetermined limit (e.g., the softening point and/or the melting point of the film, and so on). In one example, the microwave interactive construction 45 may be configured as a low optical density microwave susceptor that has an optical density of 0.10 so that the temperature of the ply 33*a* adjacent to the microwave interactive construction 45 does not exceed approximately 425-450° F. (approximately 218-232 C).

In FIG. 3B, the unpopped popcorn charge 30 is shown positioned within interior 27 of the flexible bag construction 25 in the central region 50, over, and in thermoconductive contact with, microwave interactive construction 45. When the arrangement of FIG. 3B is placed in a microwave oven in the general orientation shown, and is exposed to an adequate level of microwave energy, heat and generated steam or vapor will cause expansion of the flexible bag construction 25 and thus the package 1. During popping, the flexible bag construction 25 may vent along top gusset 39*c*. For example, top gusset 39*c* may include a plurality of vent slots 60*a* that may open to facilitate venting. Example vent slots 60*a* are further described in the discussion of FIGS. 8C and 8D. In one or more implementations, the flexible bag construction 25 may include vent slots 60*a* that are configured to vent near the end of the popping operation. In this manner, the flexible bag construction 25 may be inflated during popping so that visibility of the popping popcorn within the bag 25 is enhanced.

In addition, as the flexible bag construction 25 expands during popping, the first and second panels 10, 11 are pushed away from one another and the base gusset 39 and top gusset 39*c* are opened. In the implementation shown, the first and second panels 10, 11 may have about the same width as the flexible bag construction 25 so that the first and second panels 10, 11 enclose the flexible bag construction 25 prior to popping. However, in one or more other embodiments, the first and second panels 10, 11 my have a width that is narrower than the bag flexible construction 25 so that portions of the flexible bag construction 25 (e.g., portions of the top gusset 39*c* and the base gusset 39) project outwardly from between the first and second panels 10, 11 beyond the top edge 9*a* and the bottom edge 9*b*. For example, the first and second panels 10, 11 may have a width that allows the top gusset 39*c* and the base gusset 39 of the flexible bag construction 25 to extend beyond top edge 9*a* and bottom edge 9*b* by about 2.54 cm, respectively.

In example implementations, each of the first and second panels 10, 11 for a microwave package of the type depicted in FIGS. 1 through 3B may be configured to provide outer dimensions of at least about 20 cm (e.g., 20-40 cm) long (wide) by at least about 10 cm (e.g., 10 to 22 cm) high to contain 25 to 80 g unpopped popcorn kernels, when collapsed. Referring to FIGS. 2A and 2B, the package 1, prior to popping operation, can be conveniently stored within a moisture barrier outer package or wrap, such as a polyethylene or oriented polypropylene wrap, for storage, shipment, and display. In addition, the surfaces of the first and second panels 10, 11, as well as the flexible bag construction 25, for example in region 40, may be used for printing to display graphics or information. Moreover, in implementations, the interior surface of the second panel 11 (and the first panel 10) may be treated to be grease resistant (e.g., with a film forming starch treatment, an alginate treatment, an acrylic resin treatment, a fluorochemical treatment, or the like).

The appropriate orientation for the package 1, when placed in a microwave oven for popping, as shown in FIGS. 3A and 3B, is generally with: the second panel 11 adjacent to microwave interactive construction 45, positioned down; and, with the unpopped popcorn kernels positioned above the microwave interactive construction 45. In this manner, the heat generated at the microwave interactive construction 45 is underneath the popcorn.

Figure 4A:
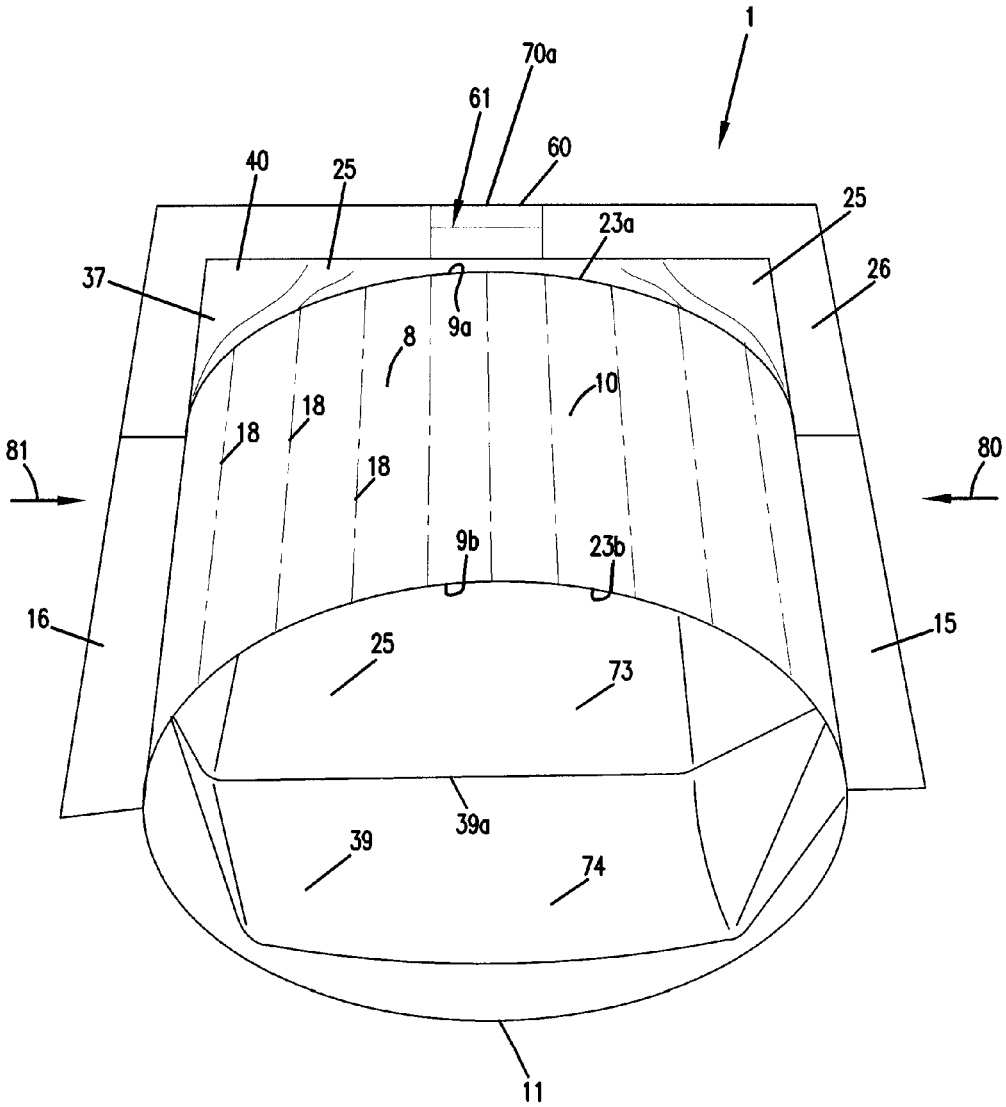
FIGS. 4A and 4B are schematic, perspective views of the microwave popcorn packages of FIGS. 2A and 2B and FIGS. 3A and 3B, respectively, depicted after microwave popcorn popping but while the packages are lying on a side, as the packages would during and immediately after popping.
Figure 4B:
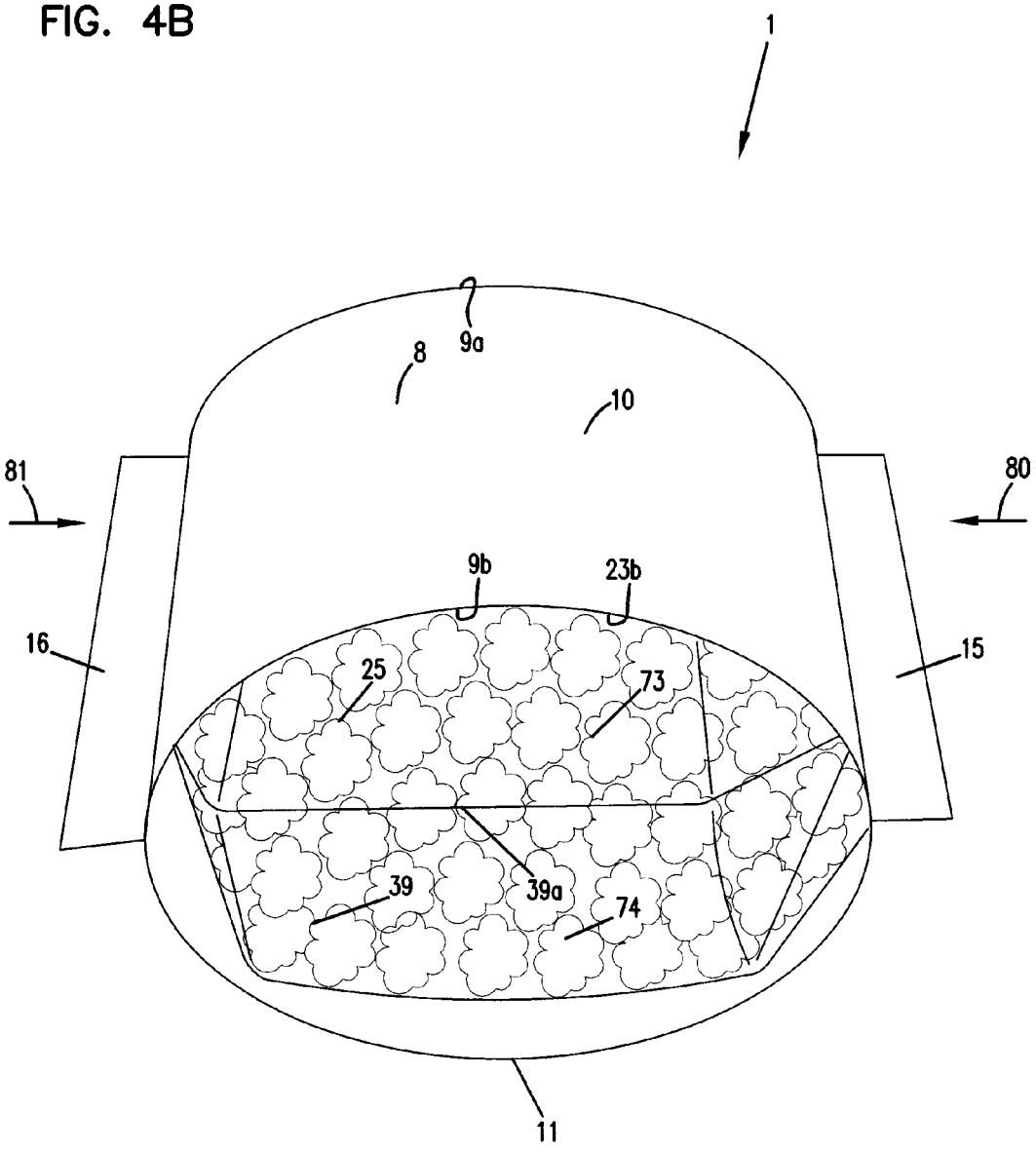

Turning now to FIGS. 4A and 4B, the microwave popcorn packages 1 are depicted in an expanded, vented orientation after microwave popping prior to opening (e.g., before tearing extension 40 [FIG. 4A] or top gusset 39*c* [FIG. 4B] from a remainder 26 of the package 1). In FIG. 4A, the flexible bag construction 25 is illustrated as being formed of opaque paper. In FIG. 4B, flexible bag construction 25 is illustrated as being generally transparent (e.g., formed of a generally transparent polyester [PET] film) to allow the contents (e.g., popped popcorn) 4 of the package 1 to be viewed through the base gusset 39. Further, the first and second panels 10, 11 are shown expanded apart, but secured together at side ends 15, 16. The flexible bag constructions 25 are shown positioned between the first and second panels 10, 11 with base gusset 39 expanded open along opposite panels 73, 74. In FIG. 4A, the fold lines 18 facilitate curving of the first and second panels 10, 11 into the configuration shown. Further facilitation of curving of the first and second panels 10, 11 can be caused by the consumer, upon grasping and pressing side ends 15, 16 toward one another, i.e., in the directions indicated generally at arrows 80, 81 respectively.

Turning now to FIGS. 5A, 5B, 5C, and 5D, the vented, expanded, packages 1 of FIGS. 4A and 4B are depicted standing upright. As noted above, it may be convenient for the consumer to apply pressure against the side ends 15, 16 in the direction of arrows 80, 81 after popping to facilitate formation of the package into the generally convex arrangement shown. Also, the consumer may shake the package 1 or tap it (e.g., against a surface), to facilitate settling the popcorn before opening.

Figure 5A:
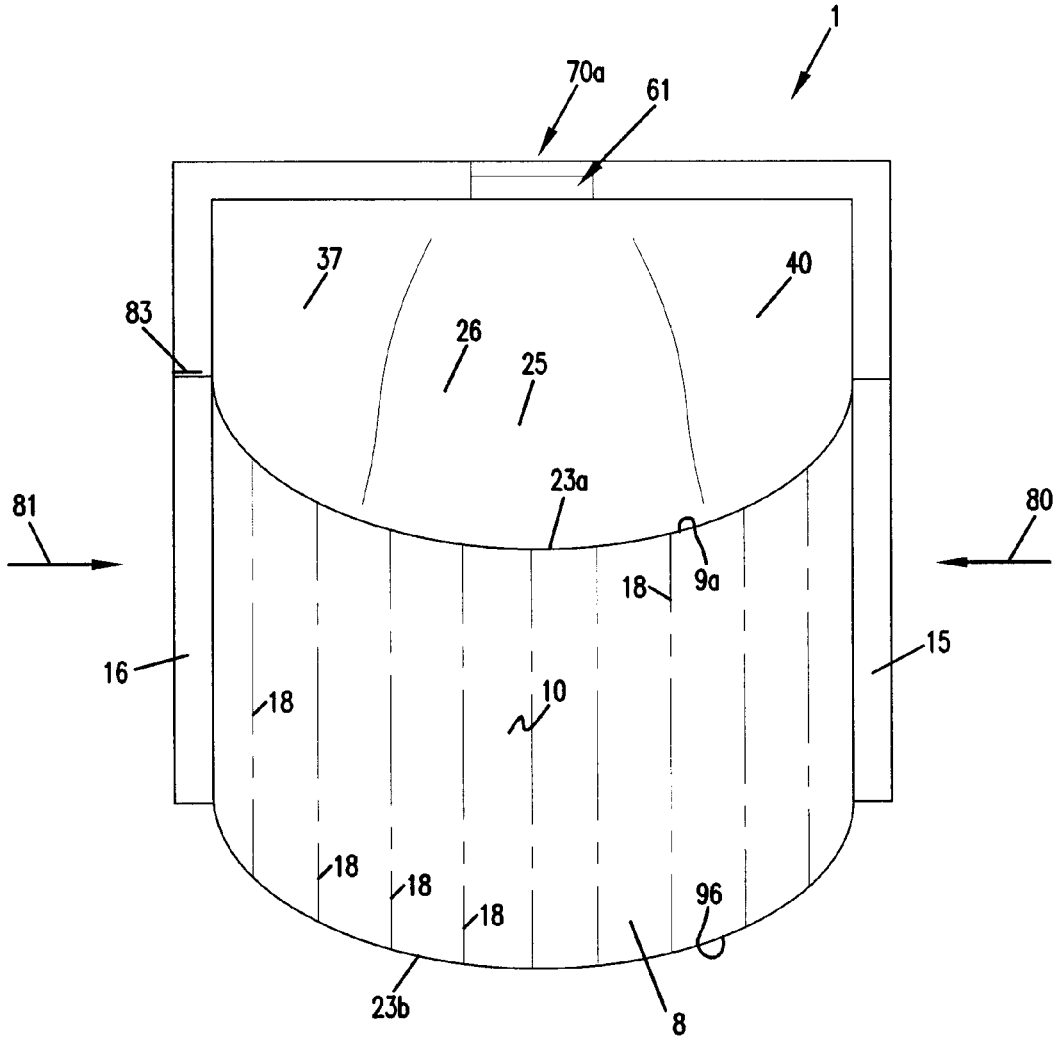
FIG. 5A is a depiction of the microwave popcorn package of FIG. 4A, after microwave popcorn popping, but shown stood up on the package's base.
Figure 5B:
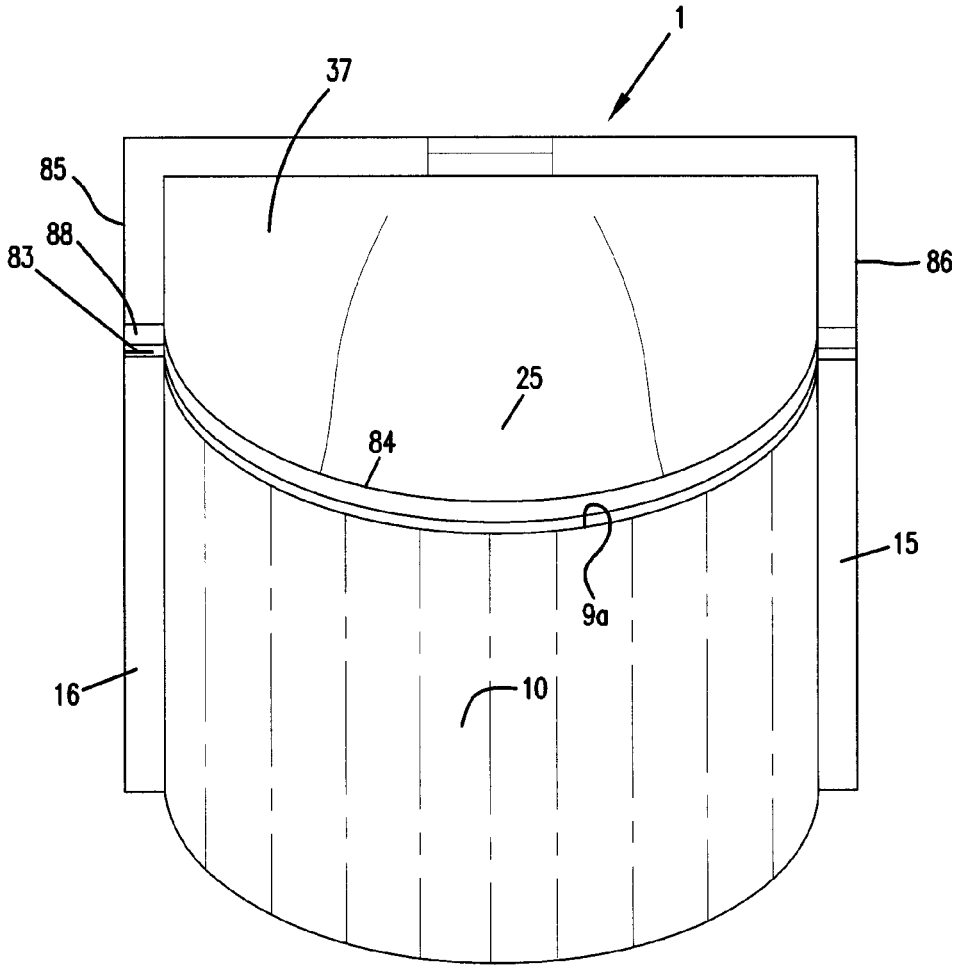
FIG. 5B is a depiction of an example microwave popcorn package after microwave popcorn popping, but shown stood up on its base, wherein the microwave popcorn package employs a tear strip.

FIGS. 5A and 5B illustrate a flexible bag construction 25 that includes extension 40, as shown in FIGS. 2A and 3A, in the expanded configuration. A variety of techniques may be used to facilitate removal of the extension 40 from the remainder of the flexible bag construction 25. For example, the flexible bag construction 25 may be scored or perforated along a line extending around the flexible bag construction 25 to facilitate removal of extension 40. Tear tape may be provided in place of or in addition to scoring or perforations formed in the bag construction 25. In embodiments, tear tape may comprise a strip of material that reinforces the base substrate and provides a way to tear the base substrate cleanly along a line extending around the bag construction 25 (such as the line of scoring or perforations) without ripping of the substrate at angles to the line. In FIG. 5A, an implementation of the flexible bag construction 25 is illustrated that includes a tear line (e.g., a cut or notch) 83 provided in the flexible bag construction 25 to facilitate opening of the bag by removal of extension 40.

In FIG. 5B, implementation of the flexible bag construction 25 is illustrated that includes a tear strip 84. As shown, the tear strip 84 is disposed on an exterior surface of the first and second opposite sides 37, 38 (shown in FIG. 3A) of the flexible bag construction 25. The tear strip 84 may extend from a first edge 85 of each of the first and second opposite sides 37, 38 to an oppositely disposed second edge 86 of each of the first and second opposite sides 37, 38. In one example, the tear strip 84 is disposed on the flexible bag construction 25 such that the tear strip 84 is adjacent to the top edge 9*a* of the sidewall construction 8 when the package 1 is in the expanded configuration. In another example, the tear strip 84 is disposed on an interior surface of the first and second opposite sides 37, 38 of the flexible bag construction 25. A notch 87 (shown in FIG. 7A) may be disposed in the flexible bag construction 25 at the first edge 85. The tear strip 84 includes a grip projection 88 that extends into the notch 87. The notch 87 provides a location at which the grip projection 88 of the tear strip 84 to be grasped and pulled to expose the content (e.g., popped popcorn) 4. The tear strip 84 may be made from a high-temperature polyester material having a width in a range of about ⅛ inch to about 1 inch (e.g., about ¼ inch to about ¾ inch). In one example, the width of the tear strip 84 may be at least ¼ inch.

Figure 5C:
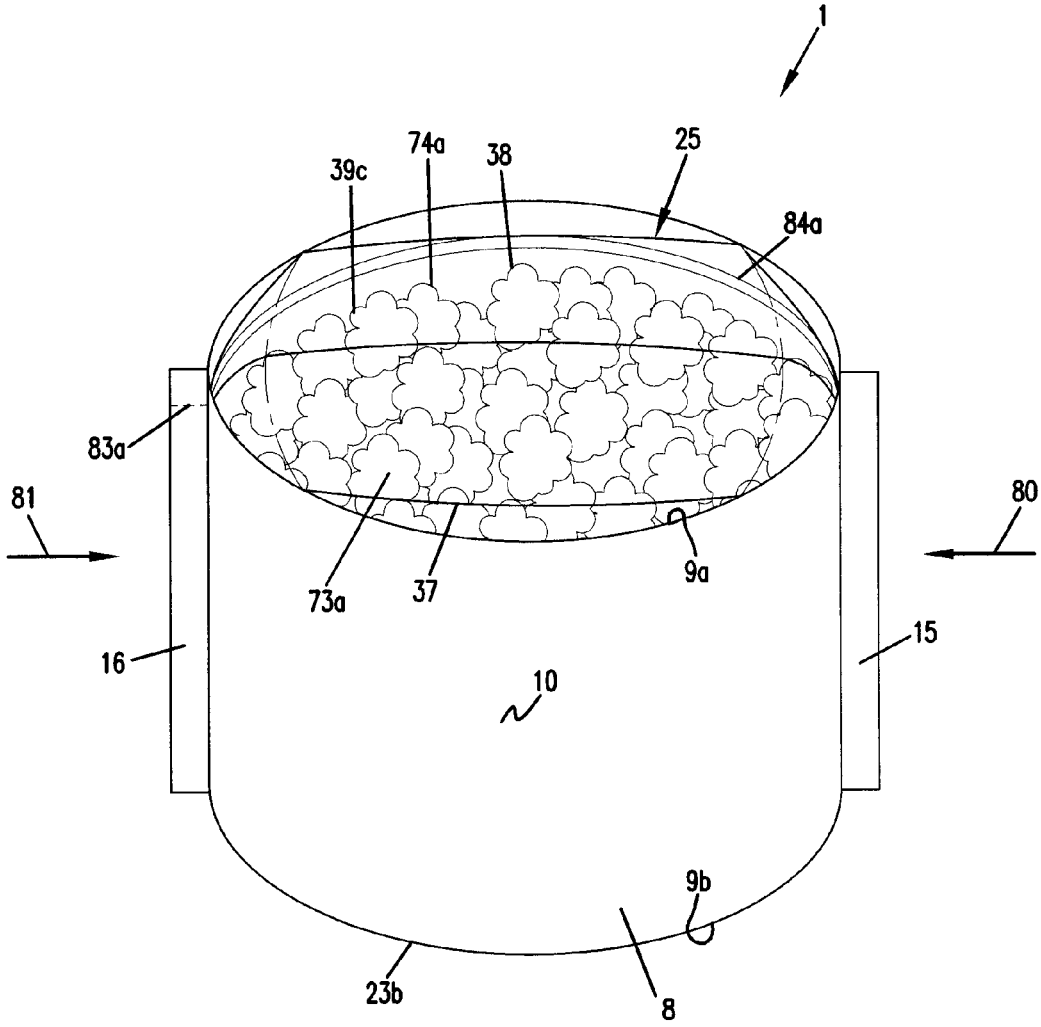
FIG. 5C is a depiction of the microwave popcorn package of FIG. 4B, after microwave popcorn popping, but shown stood up on the package's base.

FIG. 5C illustrates a microwave popcorn package 1 that includes a flexible bag construction 25 having a top gusset 39*c*, as shown in FIGS. 2B and 3B, wherein the package 1 is shown in the expanded configuration. A variety of techniques may be used to facilitate removal of the top gusset 39*c* from the remainder of the flexible bag construction 25. For example, in FIG. 5C, a tear line (e.g., a cut or notch) may be provided in the flexible bag construction 25 at 83*a* to facilitate opening of the bag 25 by removal of top gusset 39*c*. In the example shown, the tear line 83*a* is positioned above the adhesive line at the base of the top gusset 49 where the flexible bag construction 25 attaches to the sidewall construction 8. Thus, the tear line 83*a* is below the top edge 9*a* of the sidewall construction 8 when the package 1 is in the expanded configuration.

In one or more implementations, the flexible bag construction 25 may employ tear tape 84*a* affixed to the ply 33*a* to facilitate tearing of the top gusset 39*c* from the flexible bag construction 25. As shown, the tear tape 84*a* extends along and is generally parallel to the adhesive line at the base of the top gusset 39*c* where the flexible bag construction 25 attaches to the sidewall construction 8. Thus, the tear tape 84*a* is positioned below the top edge 9*a* of the sidewall construction 8 when the package 1 is in the expanded configuration. For example, the tear tape 84*a* is disposed on an exterior surface of the first and second opposite sides 37, 38 (shown in FIG. 3B) of the flexible bag construction 25. The tear tape 84*a* may extend from a first edge 85 of each of the first and second opposite sides 37, 38 to an oppositely disposed second edge 86 of each of the first and second opposite sides 37, 38. In one example, the tear tape 84*a* may be made from a high-temperature polyester material having a width of about ¼ inch. The tear tape and/or the underlying ply 33*a* may be scored to facilitate tearing. Scoring of the tear tape 84*a* and/or the underlying ply 33*a* is further described in the discussion of FIGS. 8C and 8D.

Figure 6A:
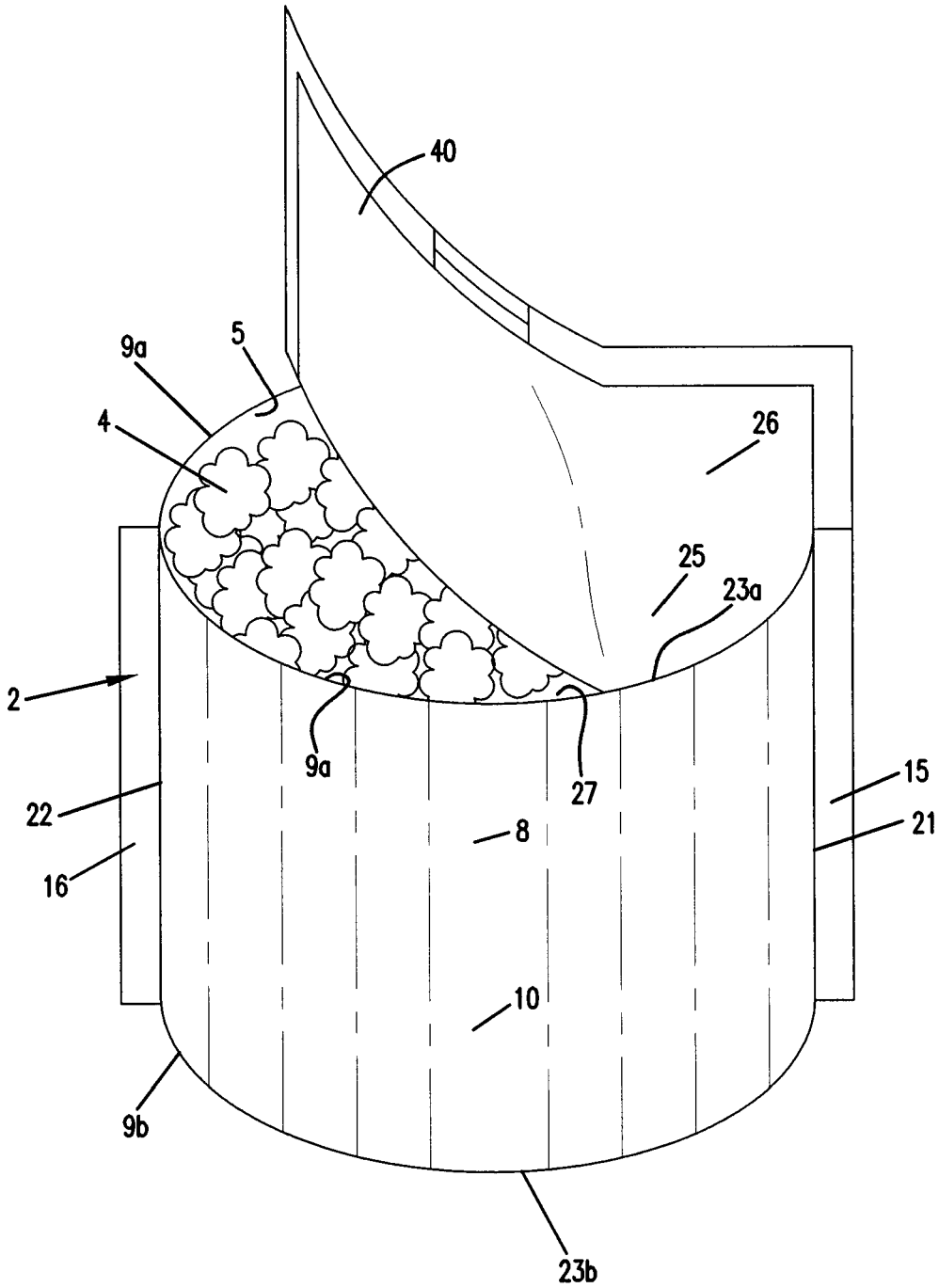
FIG. 6A is a depiction of microwave popcorn package according to FIG. 5A, depicted during opening of the package.
Figure 6B:
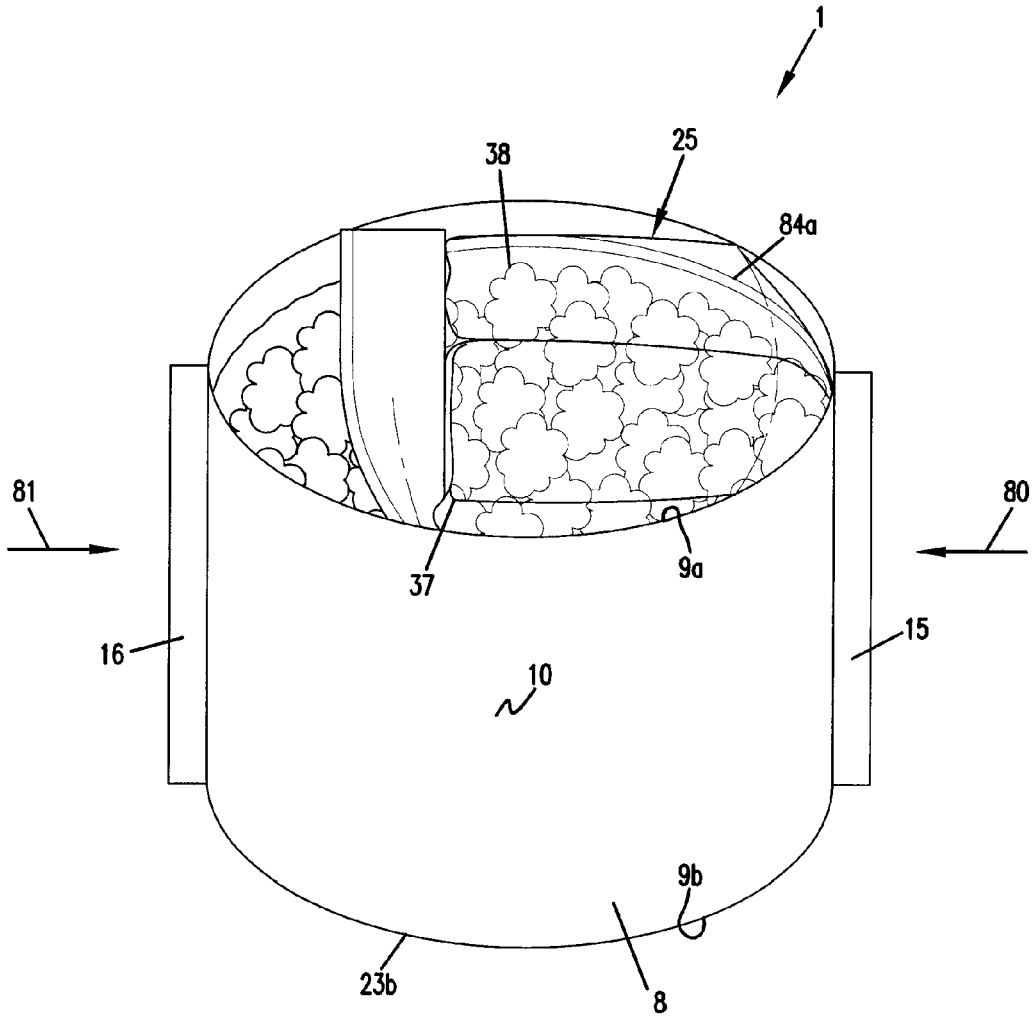
FIG. 6B is a depiction of a microwave popcorn package according to FIG. 5C, depicted during opening of the package.

In FIGS. 6A and 6B, opening of the packages 1 shown in FIGS. 4A, 4B, 5A, 5B and 5C is illustrated. In FIG. 6A, the region 40 is removed (e.g., torn) from the remainder 26 of the package 1 at top edges 9*a* to expose the contents 4 of the package 1. After the region 40 is removed from the package 1, the bowl arrangement shown in FIG. 1A results. Removal of region 40 from the package 1 may be initiated at tear line 83 (shown in FIG. 5A) or by pulling the tear strip 84 (shown in FIG. 5B).

In FIG. 6B, the top gusset 39*c* is torn from the remainder 26 of the microwave popcorn package 1 to expose the contents 4 of the package 1. After the top gusset 39*c* is removed from the package 1, the bowl arrangement of FIG. 1B results. The tearing of the top gusset 39*c* from the package 1 may be initiated at tear line 83 (shown in FIG. 5C).

In some instances, after the top portion 40 or top gusset 39C is removed, the consumer may increase the curvature to the sidewall construction 8 by pressing the side ends 15 and 16 of the first and second panels 10, 11 of the sidewall construction 8 together.

Figure 7:
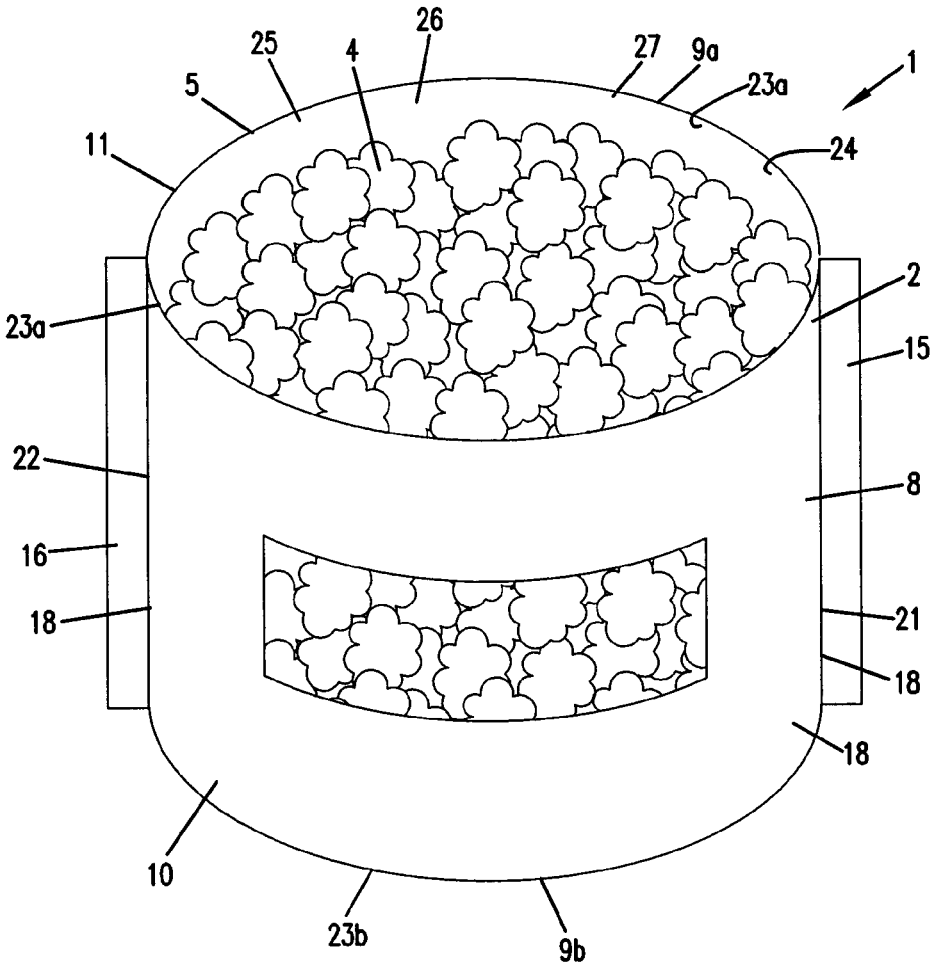
FIG. 7 is a depiction of an example microwave popcorn package that includes a window disposed in a sidewall of the package so that the contents of the package are visible through the window.

In one or more implementations, the microwave popcorn package 1 may include a window formed in the sidewall construction 8 of the package 1. For instance, as shown in FIG. 7, a window 10*a* may comprise an opening formed in the first panel 10 so that the flexible bag construction 25 is exposed there through. In the example shown, the flexible bag construction 25 is fabricated from a film material such as a polyester film material (PET) that is generally transparent to allow the contents 4 of the package to be viewed through the window 10*a*. In FIG. 7, the window is illustrated as being rectangular. However, it is contemplated that the window 10*a* may have a variety of shapes (e.g., square, round, oval, triangular, irregular, and so on). Additionally, it is contemplated that microwave popcorn packages need not employ the configuration described herein to employ a window. Thus, a conventional microwave popcorn bag may have a window provided therein. For example, a microwave popcorn bag having a conventional two-ply configuration may employ a generally transparent material (e.g., polyester film material [PET] as an inner ply). A window 10*a* may be provided in the outer ply allowing contents of the bag to be viewed. Similarly, a conventional bag (either single-ply or multi-ply) may employ a patch of generally transparent material (e.g., applied to an interior of the bag, laminated between plies of the bag, and so on) that is in registration with the window provided in the bag. Other examples are possible.

In FIGS. 2A, 3A, 4A, 5A, 5B and 6A, the flexible bag construction 25 illustrated is fabricated from an opaque paper. Consequently, the package 1 does not facilitate viewing of the contents 4. In FIGS. 2B, 3B, 4B, 5C, 5D, 6B and 7, the flexible bag construction 25 is illustrated as being fabricated from a film material such as a polyester film material (e.g., PET) that is generally transparent (e.g., transparent, translucent, and so on). Consequently, the contents (e.g., popped popcorn) 4, may be viewed through the base and top gussets 39, 39*c*, particularly, during popping and when the microwave popcorn package 1 is in the expanded configuration following popping. However, the configurations of microwave popcorn packages 1 fabricated in accordance with the present disclosure are not limited to the specific examples illustrated. For example, it is contemplated that the flexible bag construction 25 illustrated in FIGS. 4A, 5A, 5B, and 6A could be fabricated of a film material (e.g., PET), which may be generally transparent to allow the contents 4 of the package 1 to be viewed (e.g., through the base gusset 49 and/or the extension 40). Similarly, it is contemplated that the flexible bag construction 25 illustrated in FIGS. 4B, 5C, 5D, and 6B could be fabricated of opaque paper so that the contents 4 of the package 1 are no viewed prior to opening of the package 1.

In the next section, the features of the flexible bag construction 25 are described in greater detail.

Example Flexible Bag Constructions

The flexible bag construction 25 may have a variety of configurations. For example, the flexible bag construction 25 may be a single-ply arrangement, or a multi-ply arrangement, such as a two-ply arrangement, and may be formed of paper, a polyester film, and so on. As previously discussed, the depicted examples in FIGS. 1A, 2A, 3A, 4A, 5A, 5B, and 6A utilize a flexible bag construction 25 that is two-ply and formed of paper. An example blank suitable for use in fabricating this flexible bag construction 25 is described herein in reference to FIGS. 8A, 8B and 9A in greater detail. Similarly, the depicted examples in FIGS. 2B, 3B, 4B, 5C, 5D, and 6B utilize a flexible bag construction 25 that is single-ply, formed of a polyester film (e.g., PET), which may be generally transparent. An example blank suitable for use in fabricating this flexible bag construction 25 is described herein in reference to FIGS. 8C, 9B and 10 in greater detail.

Figure 8A:
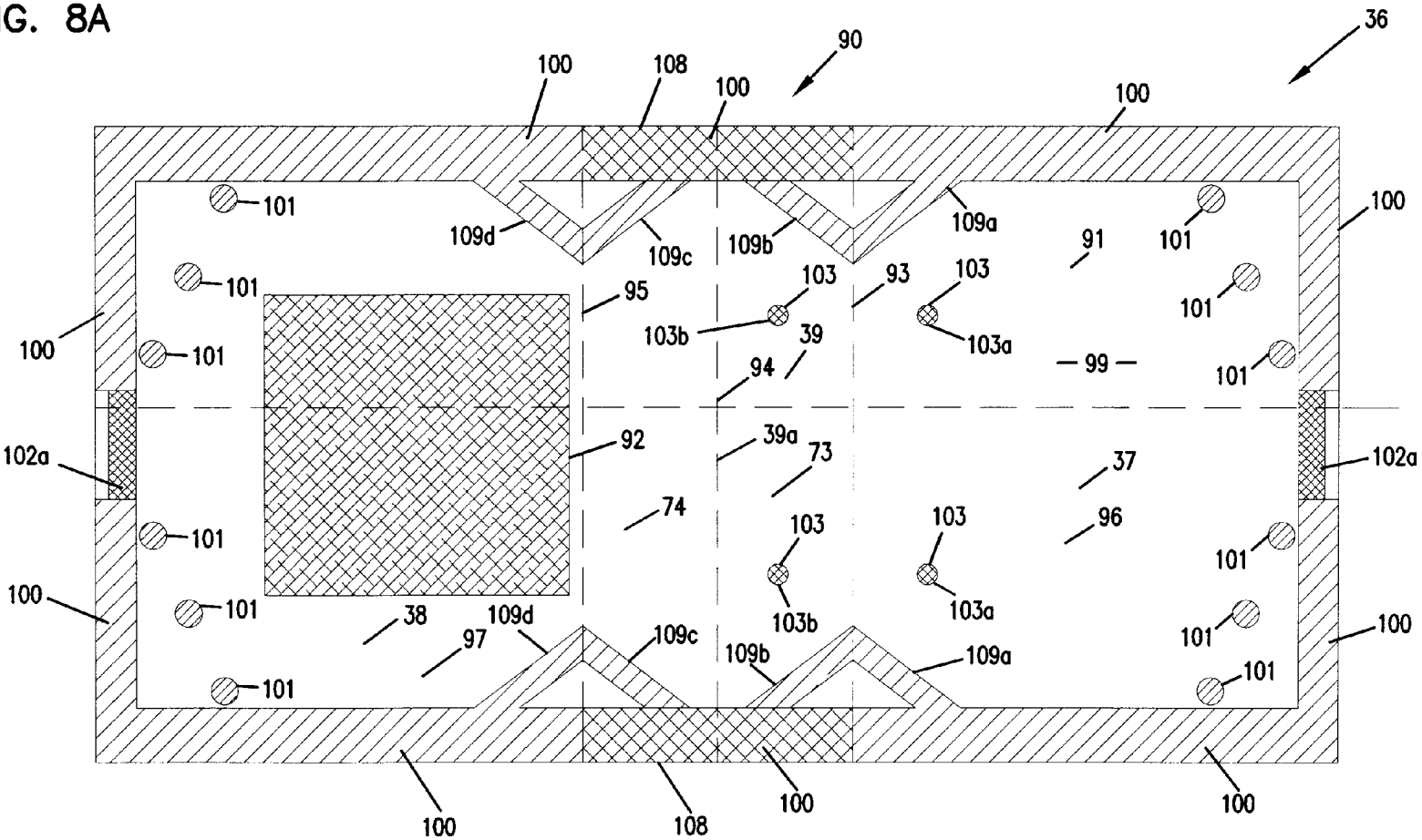
FIG. 8A is a plan view of an example flexible blank usable to form an internal bag component of the microwave popcorn package of FIGS. 2A, 3A, 4A, 5A, and 6A.
Figure 8B:
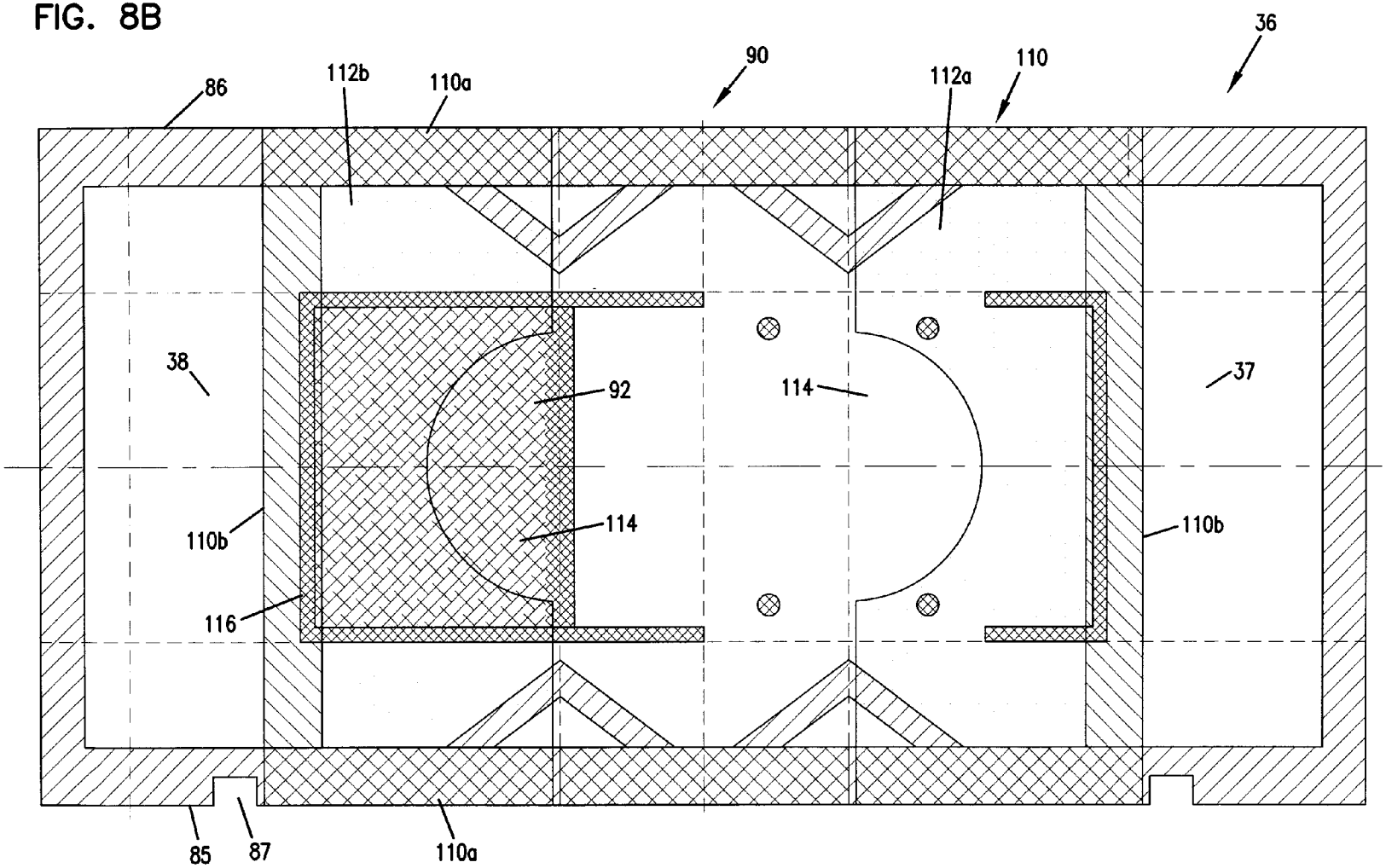
FIG. 8B is a plan view of an example blank usable to form an internal bag of the microwave popcorn package of FIG. 5B.

Referring now to FIGS. 8A and 8B, example blanks 36 suitable for use in fabricating the flexible bag constructions 25 described herein in reference to FIGS. 1A, 2A, 3A, 4A, 5A, 5B, and 6A is illustrated. In FIG. 8A, a foldable one-piece (e.g., single piece) bag blank 90 having a two-ply construction 91 with a susceptor 92 positioned between plies is shown. The particular bag blank 90 depicted is rectangular. However, other shapes can be used. Various notations described below in relation to FIG. 8A indicate: locations of fold lines; locations of seal or seam material; and, a location between the plies for a susceptor 92. Three folds along lines 93, 94, 95 are used to form bottom or base gusset 39 and side panels 73, 74 (shown in FIG. 4A). The resulting base gusset 39 is an internally directed base gusset with two side panels. Opposite sides 37, 38 of the flexible bag construction 25 are formed by regions 96 and 97, respectively. Heat seal material on upper surface 99 in the regions 101 is used to seal the two panels to one another along the panels' outer edges. Seal dots 101 are used to provide a diagonal seam and thus an example top configuration of the flexible bag construction 25. In region 102, a heat releasable seam 70*a* is provided between panels 37, 38 (shown in FIG. 5A).

Spot seals are also indicated at 103. In the completed flexible bag construction 25, adhesive at spot seals 103 close the gusset 96 against panel 73 to inhibit popcorn from entering this region during a filling and handling operation. This occurs by spot seals 103*a* being folded, around fold line 93, over and into engagement with spot seals 103*b*.

In region 108, adhesive is also provided on the back side (i.e., opposite side from the view of FIG. 8A) to provide an example base gusset configuration.

As the gussets are folded around fold line 93, diagonal seams 109*a* overlap and seal to diagonal seams 109*b*, and diagonal seams 109*c* are folded over fold line 95, into engagement with diagonal seams 109*d*. This arrangement helps form a convenient stand-up base gusset 39, in the resulting product. The resulting side edges of the flexible bag construction 25 formed from folding the blank of FIG. 8A may be positioned between the panels 10, 11, and secured into and along end seams 15, 16 (FIG. 3A).

In FIG. 8B, the bag blank 90 is illustrated as including an adhesive region 110 disposed on the backside (i.e., opposite side from the view of FIG. 8B) of the bag blank 90. The adhesive region 110 provides a location at which the flexible bag construction 25 can be secured to the interior of the sidewall construction 8. In the depicted example, the adhesive region 110 includes generally horizontal sections 110*a* that extend along the first and second edges 85, 86 of the flexible bag construction 25 and generally vertical sections 110*b* that extend between the first and second edges 85, 86 such that the adhesive region 110 outlines a generally rectangular shape. In the depicted example, the adhesive region 110 is symmetrically disposed about the center fold line 39*a*.

Within the adhesive region 110 are adhesive areas 112*a*, 112*b* that are disposed on the backsides (i.e., opposite side from the view of FIG. 8B) of the first and second sides 37, 38, respectively. The adhesive areas 112 further secure the first and second sides 37, 38 of the flexible bag construction 25 to the interior of the sidewall construction 8. In the depicted example, each of the adhesive areas 112*a*, 112*b* includes an adhesive-free zone 114. In the depicted example, the adhesive-free zone is generally semi-circular in shape. The adhesive-free zone 114 allows the flexible bag construction 25 to pull away from the sidewall construction 8 which allows for the package 1 to form a bowl-shape configuration in the expanded configuration.

In the depicted example of FIG. 8B, the susceptor 92 is surrounded by a susceptor adhesive overlap region 116. In the depicted example, the susceptor adhesive overlap region 116 has a width greater than the width of the susceptor 92 by at least 0.25 inches and a length greater than the length of the susceptor 92 by at least 0.25 inches. Exemplary adhesive patterning for the susceptor overlap region 116 has been disclosed in U.S. Pat. No. 5,753,895, entitled "MICROWAVE POPCORN PACKAGE WITH ADHESIVE PATTERN", filed on Jan. 16, 1996, and hereby incorporated by reference in its entirety.

In one or more embodiments, the flexible bag constructions 25 shown in FIGS. 8A and 8B may comprise structural materials that, in conglomerate, have a weight of no more than 60 lbs. per ream (e.g., no more than 50 lbs. per ream), and, in part as a result, are quite flexible. An example sealant for all seals on the blank of FIGS. 8A and 8B, and as a laminating adhesive between the plies, is a polyvinyl acetate adhesive, such as Duracet 12 from Franklin, Intl. of Columbus, Ohio.

Figure 8C:
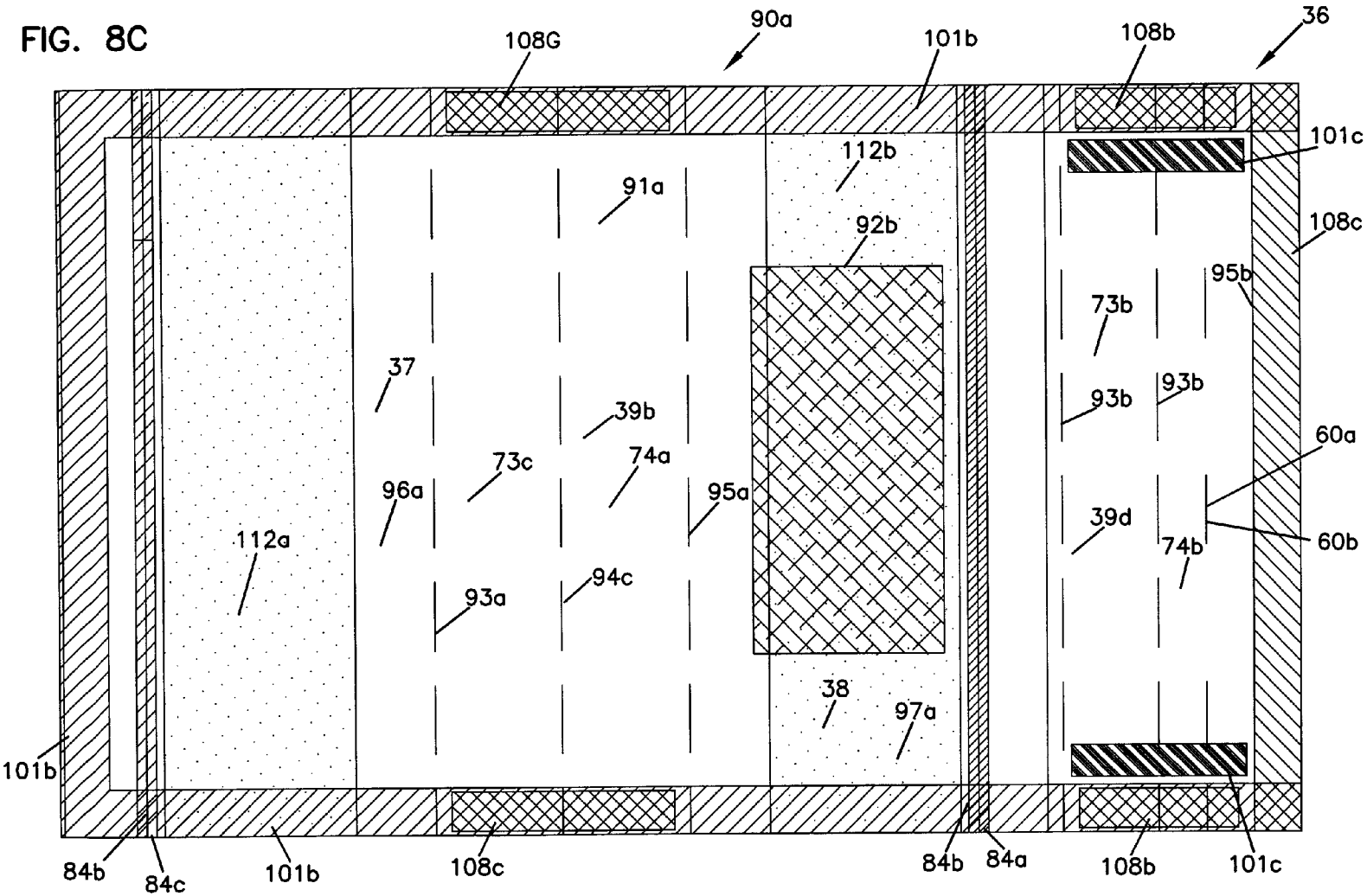
FIG. 8C is a plan view of an example blank usable to form an internal bag component of the microwave popcorn package of FIGS. 2B, 3B, 4B, 5C, and 6B.

Referring now to FIG. 8C, an example blank 36 suitable for use in fabricating the flexible bag construction 25 described herein in reference to FIGS. 1B, 2B, 3B, 4B, 5C, and 6B is shown. In FIG. 8C, the example blank 36 comprises a foldable one-piece (e.g., single piece) bag blank 90*a* having a single-ply construction 91*a* with a susceptor 92*a* affixed to the back side of the blank 90*a* (i.e., opposite side from the view of FIG. 8C). As described herein, the bag blank 90*a* may comprise a polyester film (e.g., PET) material, and may be generally transparent as described herein. For instance, in a specific example, the blank 90*a* may be formed of transparent 92 gauge PET film. However, the use of blanks 90*a* formed of other materials is contemplated. Additionally, the particular bag blank 90*a* depicted is rectangular. However, it is contemplated that the bag blank 90*a* may have other shapes.

As in FIGS. 8A and 8B, the notations described below in relation to FIG. 8C indicate: locations of fold lines; locations of seal or seam material; score lines; and a location for attachment of the susceptor 92*a*. Three folds along lines 93*a*, 94*a*, 95*a* are used to form base gusset 39*c* and side panels 73*a*, 74*a* (shown in FIG. 4B). Similarly, three folds along lines 93*b*, 94*b*, 95*b* are used to form top gusset 39*c* and side panels 73*b*, 74*b* (shown in FIG. 5C). The resulting base gusset 39 and top gusset 39*c* are longitudinal, internally directed gussets with two side panels.

Opposite sides 37, 38 of the flexible bag construction 25 are formed by regions 96*a* and 97*a*, respectively. Adhesive in areas 101*b* is used to seal the edges of sides 37, 38 together, thereby forming a bag configuration. The resulting side edges of the flexible bag construction 25 formed from folding the blank 90*a* may be positioned between the panels 10, 11, and secured into and along end seams 15, 16 (FIG. 2B). In regions 108*a*, 108*b*, adhesive is also provided on the back side (i.e., opposite side from the view of FIG. 8C) to provide the respective bottom and top gusset 39, 39*c*. Adhesive in region 108*c* is further provided on the back side (i.e., opposite side from the view of FIG. 8C) to seal the flexible bag construction 25 closed along the top gusset 39*c*. Indicia, such as a tinted (e.g., red) bar, or the like, may be applied to areas 101*c*, for example, to aide in providing instruction to direct a consumer in opening of the package 1 following popping.

As shown, the bag blank 90*a* includes adhesive areas 112*a*, 112*b* that are disposed on the back sides (i.e., opposite side from the view of FIG. 8C) of the first and second sides 37, 38, respectively. The adhesive areas 112*a*, 112*b* secure the first and second sides 37, 38 of the flexible bag construction 25 to the interior of the sidewall construction 8. In FIG. 8C, the microwave interactive construction 92*a* is affixed to the back side of the second side 38. Adhesive within adhesive areas 112*a*, 112*b* is then applied over the microwave interactive construction 45. An example adhesive suitable to adhere the flexible bag construction 25 to the interior of sidewall construction 8 (e.g., for use in adhesive areas 112*a*, 112*b* of FIG. 8C) is adhesive no. 45675-2N from Forbo Bonding Systems, Baar, Switzerland.

Tear tape 84*a* may be applied to the blank 90*a* to facilitate tearing of the top gusset 39*c* from the remainder 26 of the flexible bag construction (FIG. 6B). As shown, the tear tape 84*a* may extend along the edges of adhesive areas 112*a*, 112*b*, respectively. The tear tape and/or the underlying blank 90*a* may further be scored to facilitate tearing. For instance, in the example illustrated, score lines 84*b* may be applied to the polyester film material used in the fabrication of the blank 90*a* beneath the tear tape 84*a*.

Figure 8D:
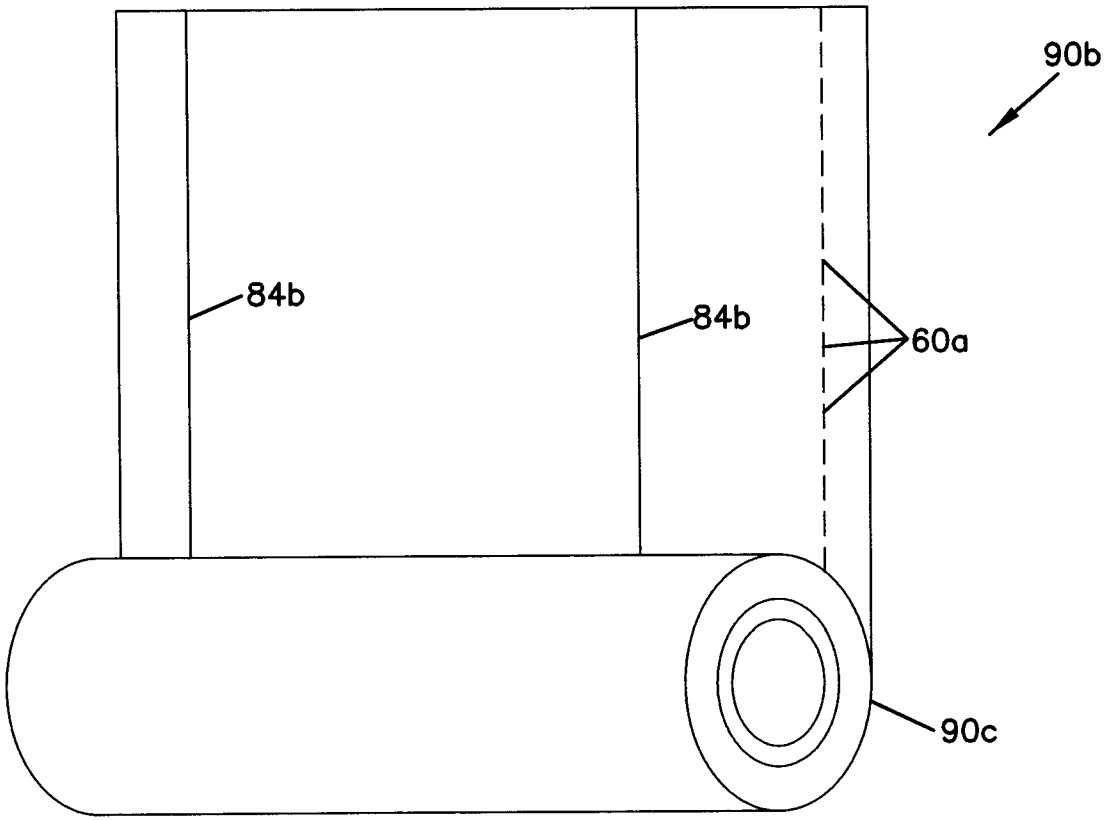
FIG. 8D is a depiction of example scoring of film used in the fabrication of the bag blank illustrated in FIG. 8C.

As shown, the blank 90*a* may be scored to provide a plurality of vent slots 60*a* that may open during popping to facilitate venting. In the example illustrated, the vent slots 60*a* may comprise short, linearly spaced lines 60*b* scored into the polyester film from which the blank 90*a* is fabricated. During popping, pressure within the flexible bag construction 25 may cause the lines 60*b* to open providing vent slots 60*a* to vent pressure from the bag construction 25. FIG. 8D illustrates scoring of polyester film material (e.g., PET) 90*b* used in the fabrication of bag blank 90*a* of FIG. 8C. As shown, the polyester film material 90*a* may be provided in a roll 90*b* having a width that corresponds to the width of the blank 90 (e.g., equal to dimension 250A in FIG. 9B). Score lines 84*b* and vent slots 60*a* are formed via laser etching. In one or more examples, the score lines 84*b* and/or the vent slots 60*a* extend only partially through the polyester film material 90*a*. In other examples, the score lines 84*b* and/or the vent slots 60*a* may comprise perforations of the polyester film material 90*a*. In one or more implementation, the lines 60*b* may be configured to open to provide vent slots 60*a* near the end of the popping operation. In this manner, the flexible bag construction 25 may be inflated during popping so that visibility of the popping popcorn within the bag 25 is enhanced.

Figure 9A:
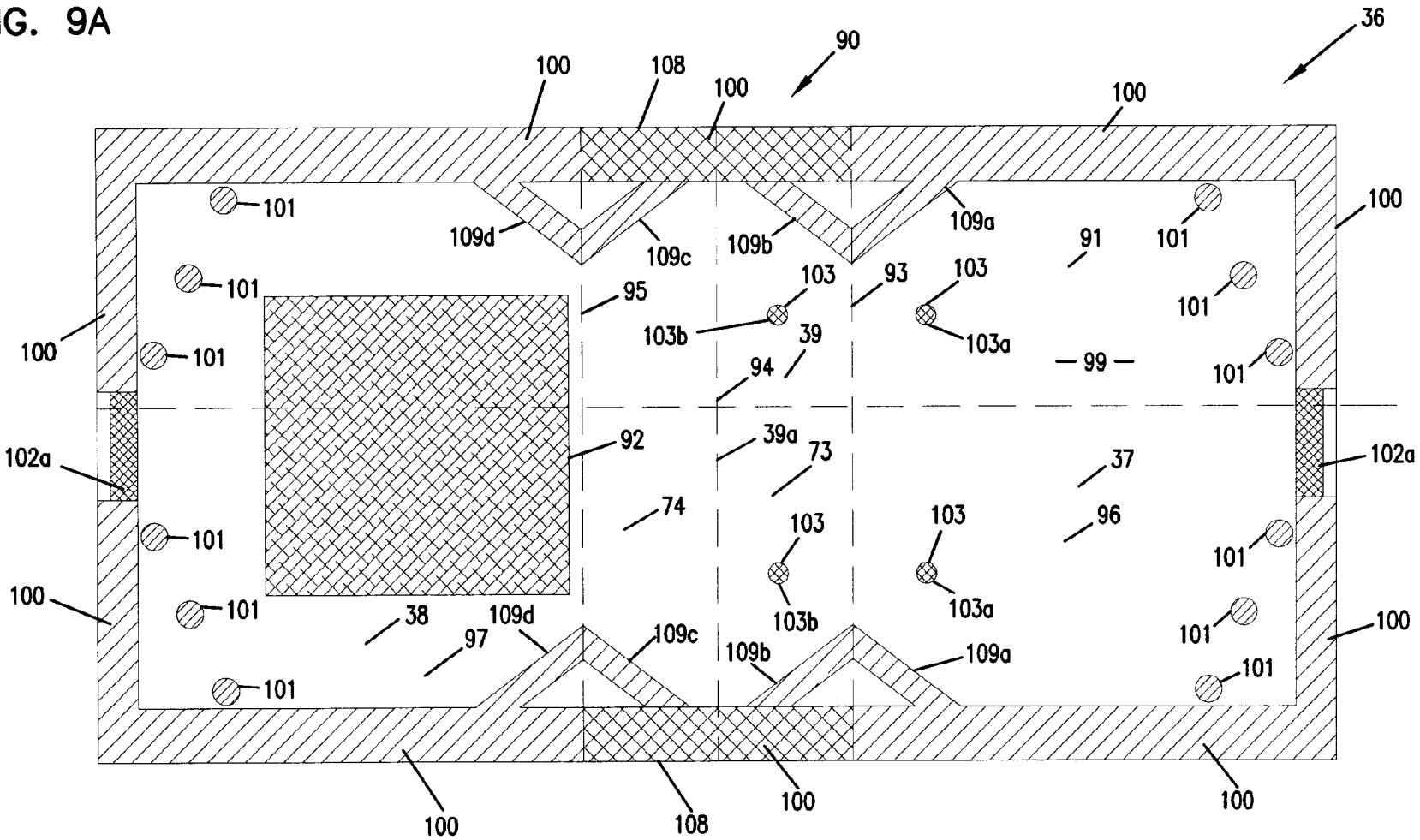
FIG. 9A is a view of FIG. 8A, showing example dimensions and angles for a particular implementation of the microwave popcorn package.

In FIG. 9A, the example blank 90 of FIG. 8A is depicted with various dimensions and angles indicated. The following table provides example values and ranges for those dimensions and angles.

TABLE 1A

Example Dimensions and Angles for FIG. 8A

| | Angle | | |
|---|---|---|---|
| Dimension | Example | Example Range[1] | Example Range |
| 200A | 27 in. (68.6 cm) | 50-85 cm | 60-75 cm |
| 200B | 13.5 in. (34.3 cm) | 25-42.5 cm | 30-37.5 cm |
| 200C | 25° | 17-33° | 22-28° |
| 200D | 0.5 in. (dia) (1.27 cm) | 0.8-1.8 cm | 1-1.6 cm |
| 200E | 5.625 in. (14.29 cm) | 18-20 cm | 11-17 cm |
| 200F | 3.062 in. (7.78 cm) | 4-12 cm | 6-9 cm |
| 200G | 0.125 in. (0.32 cm) | 0.1-0.8 cm | 0.2-0.6 cm |
| 200H | 1 in. (2.54 cm) | 1.8-4.0 cm | 1.9-3 cm |
| 200I | 0.75 in. (1.9 cm) | 1.7-2.8 cm | 1.7-2.2 cm |
| 200J | 0.75 in. (1.9 cm) | 1.7-2.8 cm | 1.7-2.2 cm |
| 200K | 0.25 in. (0.63 cm) | 0.4-0.7 cm | 0.5-0.7 cm |
| 200L | 11.625 in. (29.53 cm) | 25-40 cm | 25-35 cm |
| 200M | 2 in. (5 cm) | 3-8 cm | 3.8-6.35 cm |
| 200N | 5.5 in. (14 cm) | 8-20 cm | 11-17 cm |
| 200P | 5.81 in. (14.8 cm) | 10-20 cm | 12.5-17.5 cm |
| 200Q | 37° | 30-45° | 33-41° |
| 200R | 0.5 in. (1.27 cm) | 0.8-2 cm | 1-1.5 cm |
| 200S | 2.25 in. (5.72 cm) | 4.5-7.6 cm | 5-6 cm |
| 200T | 6.5 in. (16.5 cm) | 12-22 cm | 13-19 cm |
| 200U | 2.75 in. (6.99 cm) | 6-8 cm | 6.5-7.5 cm |
| 200V | 2.75 in. (6.99 cm) | 6-8 cm | 6.5-7.5 cm |
| 200W | 1 in. (2.54 cm) | 1.8-4.0 cm | 1.9-3 cm |

[1]A wide range, not limited to the values in the table, can be used. In this category, example ranges for arrangements like those depicted are provided.

Figure 9B:
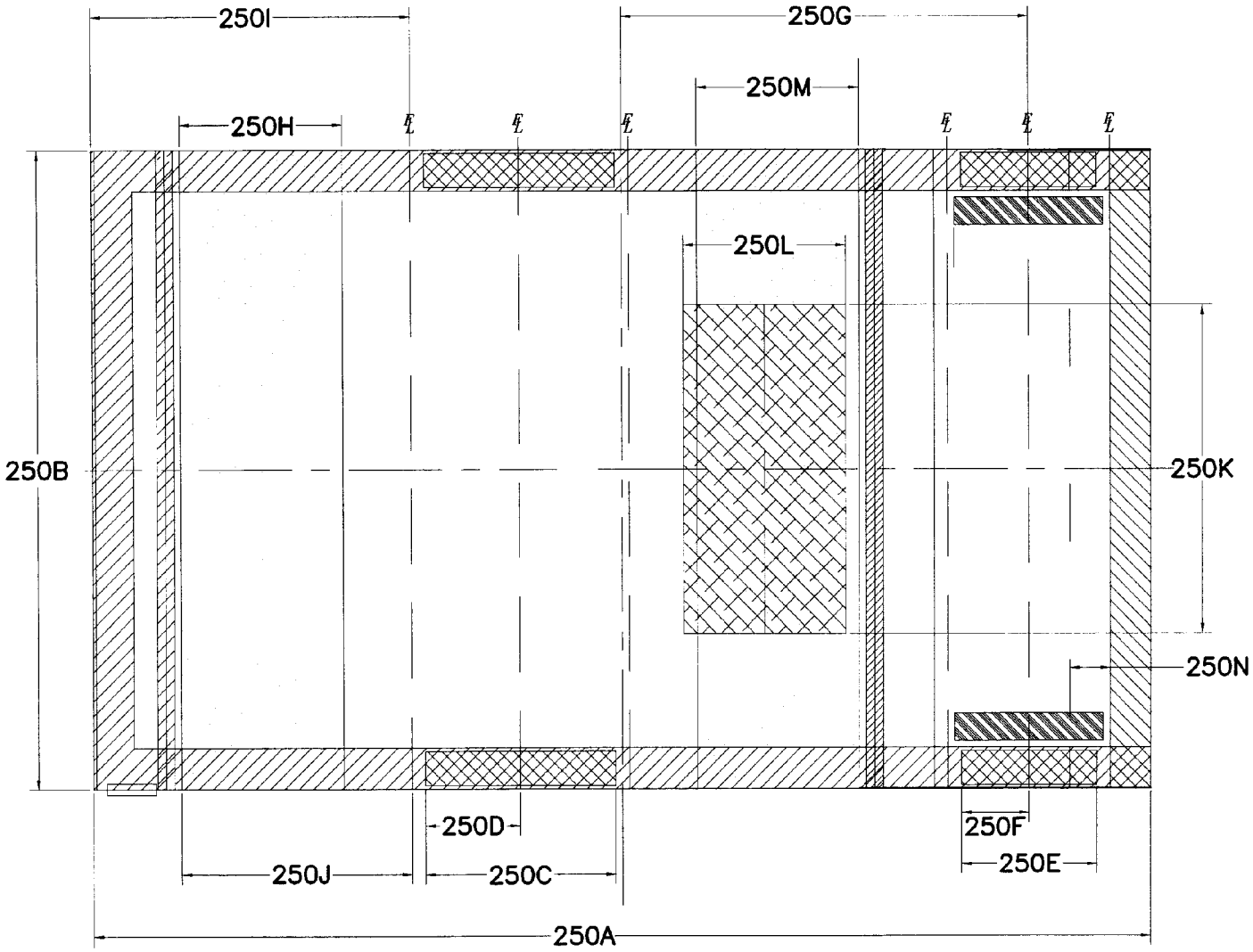
FIG. 9B is a view of FIG. 8C, showing example dimensions and angles for a particular implementation of the microwave popcorn package.

In FIG. 9B, the example blank 90*a* of FIG. 8C is depicted with various dimensions indicated. The following table provides example values and ranges for those dimensions.

TABLE 1B

Example Dimensions for FIG. 8C

| Dimension | Example |
|---|---|
| 250A | 19.5 in. (49.5 cm) |
| 250B | 11.625 in. (29.5 cm) |
| 250C | 3.5 in. (8.9 cm) |
| 250D | 1.75 in. (4.4 cm) |
| 250E | 2.5 in. (6.4 cm) |
| 250F | 1.25 in. (3.2 cm) |
| 250G | 7.5 in. (19.1 cm) |
| 250H | 3 in. (7.6 cm) |
| 250I | 5.875 in. (14.9 cm) |
| 250J | 4.25 in. (10.8 cm) |
| 250K | 6 in. (15.2 cm) |
| 250L | 3 in. (7.6 cm) |
| 250M | 3 in. (7.6 cm) |
| 250N | 1.5 in. (3.8 cm) |

A variety of other bag blank configurations are possible.

Example Sidewall Construction

Figure 10A:
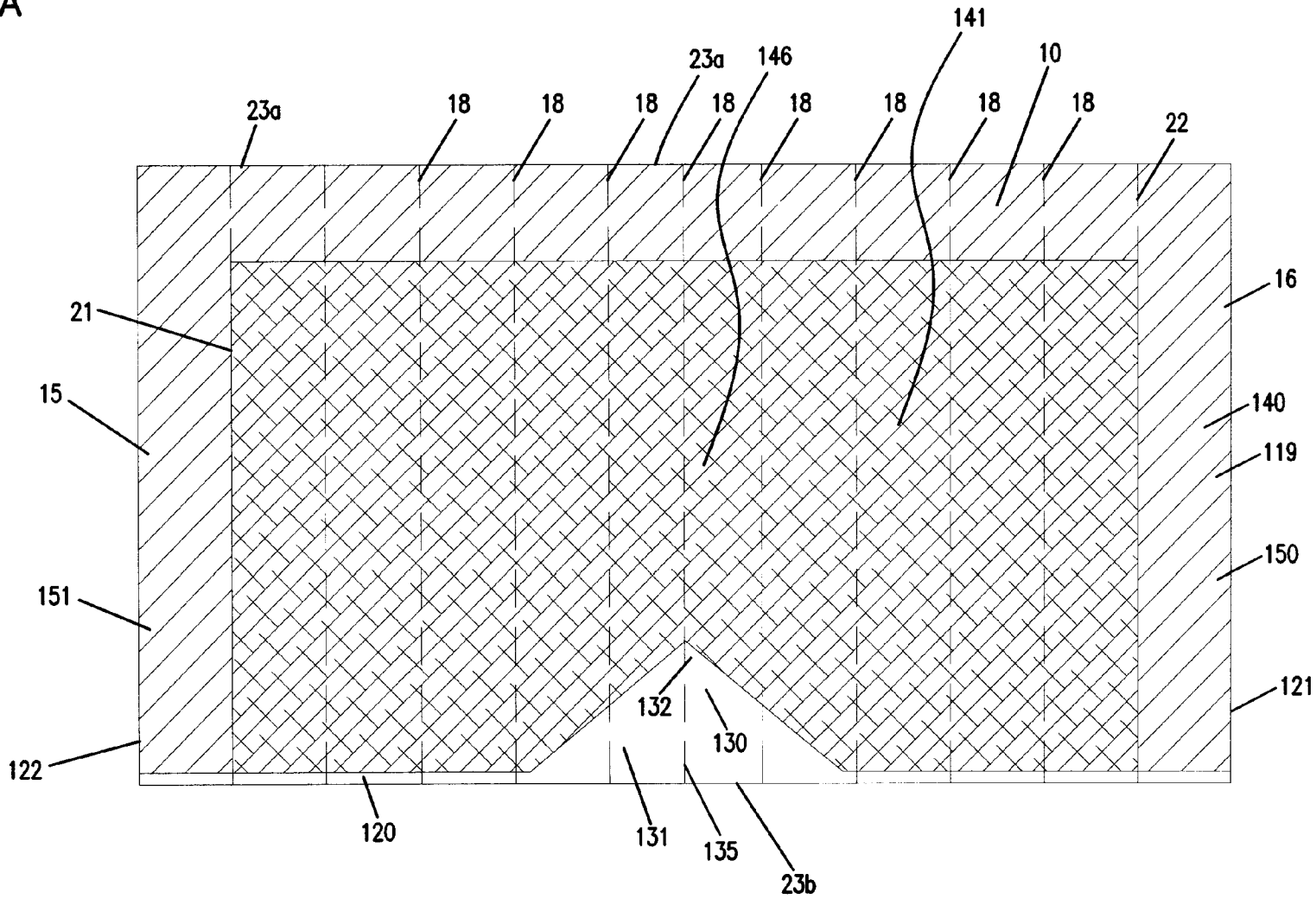
FIG. 10A is a plan view of an example sidewall panel suitable for use in the microwave popcorn package of FIGS. 2A, 3A, 4A, 5A, and 6A.
Figure 10B:
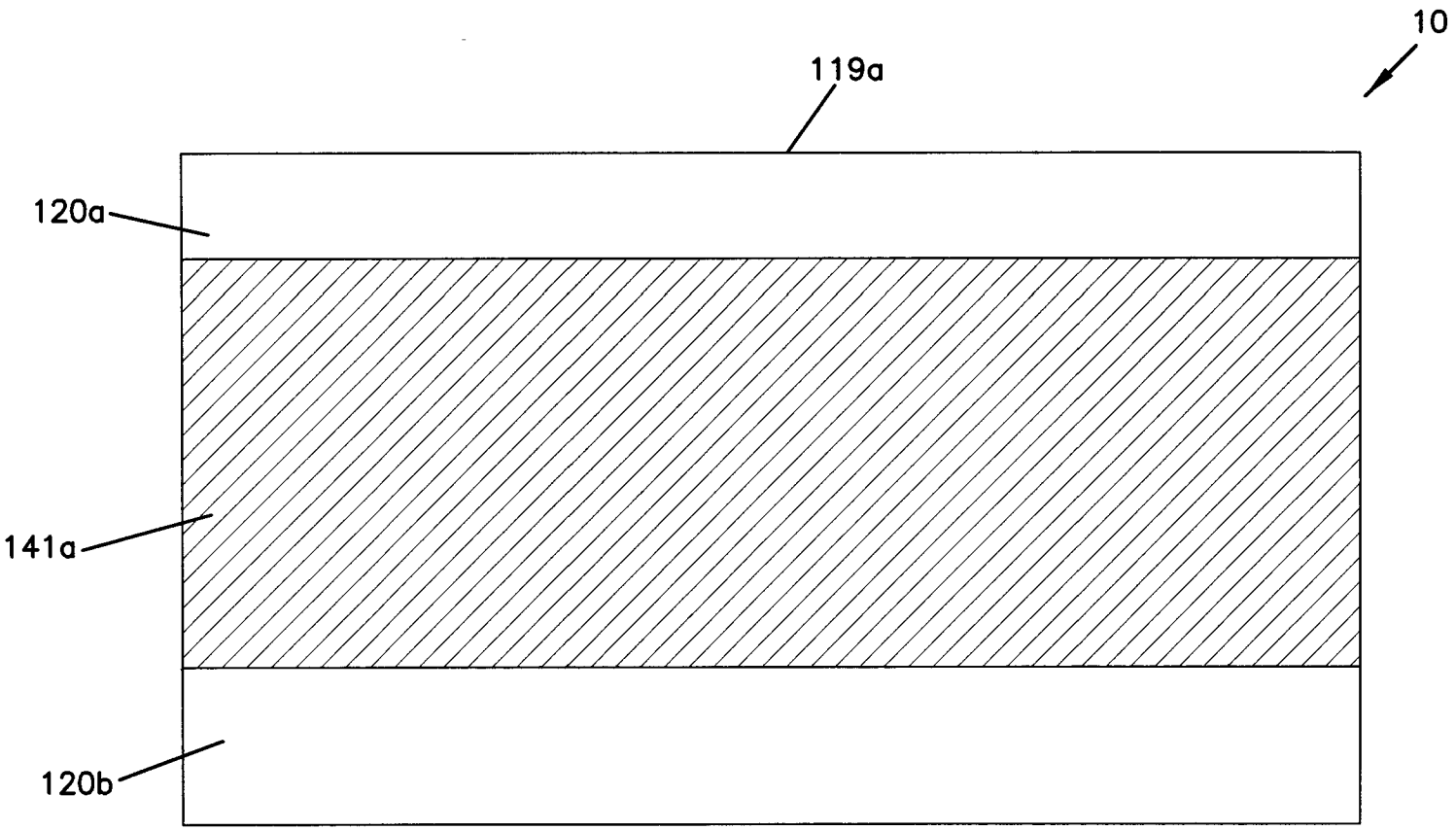
FIG. 10B is a plan view of an example sidewall panel suitable for use in the microwave popcorn package of FIGS. 2B, 3B, 4B, 5C, and 6B.

In FIGS. 10A and 10B, first and second panels 10, 11 of the sidewall constructions 8 described in reference to FIGS. 1A, 2A, 3A, 4A, 5A and 6A or FIGS. 1B, 2B, 3B, 4B, 5B, and 6B, respectively, are illustrated. In particular, the first panels 10 are depicted. It is noted, however, that the first and second panels 10, 11 may be structurally identical to one another, positioned as mirror images.

In FIG. 10A, the panel 10 illustrated includes a surface 119 that forms a surface against the flexible bag construction 25 of FIG. 8A or 8B. An example adhesive pattern between the flexible bag construction 25 and the first panel 10 is also depicted. In particular, no adhesive would be positioned along bottom edge strip 120 between side edges 121, 122. Edge strip 120 will be positioned in package 1 to form the bottom edge 23*b* adjacent base gusset 39. A no adhesive (adhesive-free) region or strip 120 extends adjacent to and upwardly from bottom edge 23*b*, a distance of about 2 to 6 mm. This region of no adhesive helps allow the flexible bag construction 25 to pull away from the first and second panels 10, 11 immediately adjacent edge 23*b*, so the base gusset 39, FIG. 5, can conveniently open and stand up.

In central region 130, adjacent to, and joining, edge strip 120, a second region 131 of no adhesive (or adhesive-free region) is provided. No adhesive in this region allows the flexible bag construction 25 to pull away from the first and second panels 10, 11, in the bottom center, during popping and expansion. This facilitates the package 1 being stood up.

In general, region 130 should be a region containing no adhesive that is located centrally between side ends 121, 122. The region 130 may have a total area of at least 9.5 sq. cm (e.g., an area of 12 to 19 sq. cm). The region may extend away from edge 23*b* a distance of at least 2.5 cm, for example 3 to 4 cm. At its widest extension, in the direction along the direction of edge 23*b*, the region extends over a distance of at least 6 cm (e.g., 8.5 to 9.5 cm). For example, the widest extension may be a bottom region located adjacent edge strip 120 and narrowest region is an opposite top region 132. A typical configuration is a triangular shape, centered along central line 135 of the first panel 10, with the central line 135 extending generally parallel to opposite edges 121, 122, centrally positioned there between. The central line 135 could also be a crease or score line 18. It is noted that although shapes other than triangular can be used, the triangular shape provided helps provide for a symmetrical pulling away of gusset 39 from first panel 10 in this region, to create a convenient base gusset 39 for the flexible bag construction 25.

In regions 140, 141, adhesive patterns are located. The adhesive coverage in region 140 may be continuous. Thus, along top edge 23*a* a continuous extension of adhesive may be provided, as well as along side edges 121, 122. Region 140 extends at least 1.8 cm (e.g., 2 to 3 cm), inwardly from adjacent ones of edges 121, 122, and 23*a*.

Region 141 generally occupies a central portion 146 of panel 10, except for the region occupied by no adhesive regions 120, 130. It is not necessary that there be a complete adhesive coverage in region 141, although complete adhesive coverage could be used. An adhesive coverage created in a pattern that provides for no more than 60% (e.g., no more than 50%) of adhesive coverage in the region can be used, for example, by providing the adhesive in a dot pattern or in a line pattern, and so on. Patterns in accord with those shown as laminating adhesive patterns in U.S. Pat. Nos. 5,753,895; 5,928,554; 5,049,072; and 6,396,036, i.e., as patterns for laminate adhesive between plies could be adapted. These patents are incorporated herein by reference and the patterns can be used to secure the bag to the sidewall.

The second panel 11 may be configured identically to first panel 10, with respect to shape and adhesive/no adhesive regions. The flexible bag construction 25 is secured to the adhesive on each panel, between the panels. Side seams on the flexible bag construction 25 are positioned in overlap with regions 150 and 151 (shown in FIG. 10A). It is noted that the adhesive pattern discussed with respect to FIG. 9 could be provided on the outside of the flexible bag construction 25 in addition to, or as an alternative to, being provided on the first and second panels 10, 11.

In FIG. 10B, a panel 10 is illustrated that includes a surface 119*a* that forms a surface against the flexible bag construction 25 of FIG. 8C. An example adhesive pattern between the flexible bag construction 25 and the panel 10*s*, 11 is also depicted. Adhesive-free regions (e.g., strips) 120*a*, 120*b* extend along the top and bottom edges 23*a*, 23*b*. These regions 120*a*, 120*b* allow the flexible bag construction 25 to pull away from the first and second panels 10, 11 adjacent to edges 23*a*, 23*b*, so the base gusset 39 and the top gusset 39*c*, FIGS. 4B and 5C, can open during popping and facilitate the package 1 being stood up. The adhesive-free region 120*b* further allows the side panels 10, 11 to be folded apart adjacent to the top gusset 39*c*, so that the top gusset 39*c* to be grasped and removed from the remainder 26 of the package 1.

As shown, adhesive is positioned along a center region (e.g., strip) 141*a* of the surface 119*a*. Region 141 generally occupies a central portion 146 of panel 10, except for the region occupied by no adhesive regions 120*a*, 120*b*. In an example, complete adhesive coverage may be used in region 141. In other examples, an adhesive coverage created in a pattern that provides for less than complete coverage may be used. For example, a pattern that provides for adhesive coverage of no more than 60% (e.g., 50%) in region 141*a* can be used, for example, by providing the adhesive in a dot pattern or in a line pattern, and so on.

The second panel 11 may be configured identically to first panel 10, with respect to shape and adhesive/no adhesive regions. In implementations, the at least a portion of the surface 119*a* (e.g., region 141*a*) of the second panel 11 (and the first panel 10) may be treated to be grease resistant (e.g., with a film forming starch treatment, an alginate treatment, an acrylic resin treatment, a fluorochemical treatment, or the like). The flexible bag construction 25 is secured to the adhesive on each panel, between the panels. It is noted that the adhesive pattern discussed with respect to FIG. 10B may be provided on the outside of the flexible bag construction 25 in addition to, or as an alternative to, being provided on the first and second panels 10, 11.

Figure 10C:
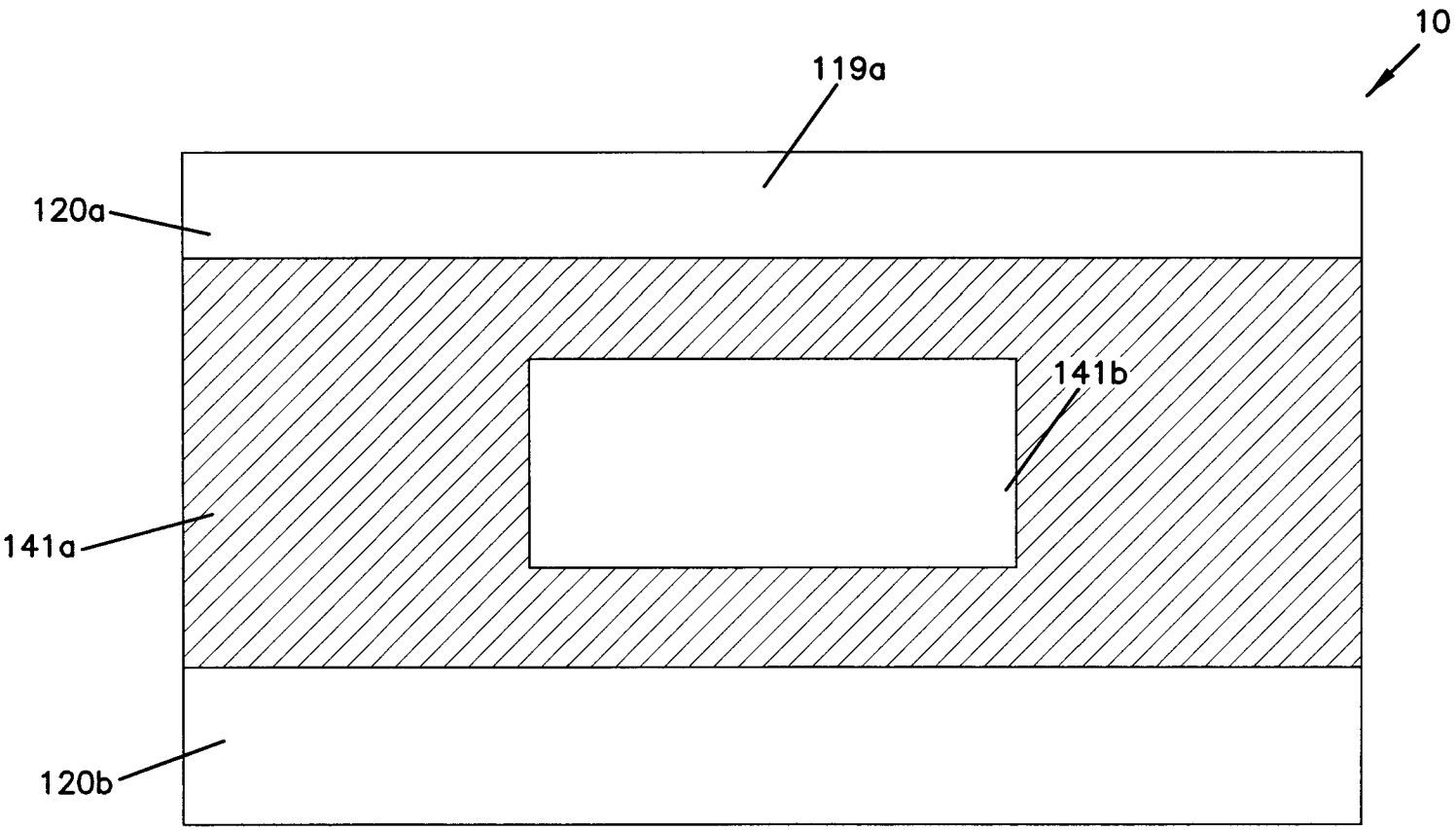
FIG. 10C is a plan view of an example sidewall panel suitable for use in the microwave popcorn package of FIG. 7.

FIG. 10C illustrates an example sidewall panel 10 suitable for use in the microwave popcorn package of FIG. 7. As in FIG. 10B, adhesive-free regions (e.g., strips) 120*a*, 120*b* extend along the top and bottom edges 23*a*, 23*b*, while adhesive is positioned along a center region (e.g., strip) 141*a* of the surface 119*a*. An opening 141*b* is formed in the first panel 10 so that the flexible bag construction 25 (FIG. 7) is exposed there through. In implementations, the second panel 11 may not include window 141*b* due to the positioning of the microwave interactive construction 45.

Figure 11A:
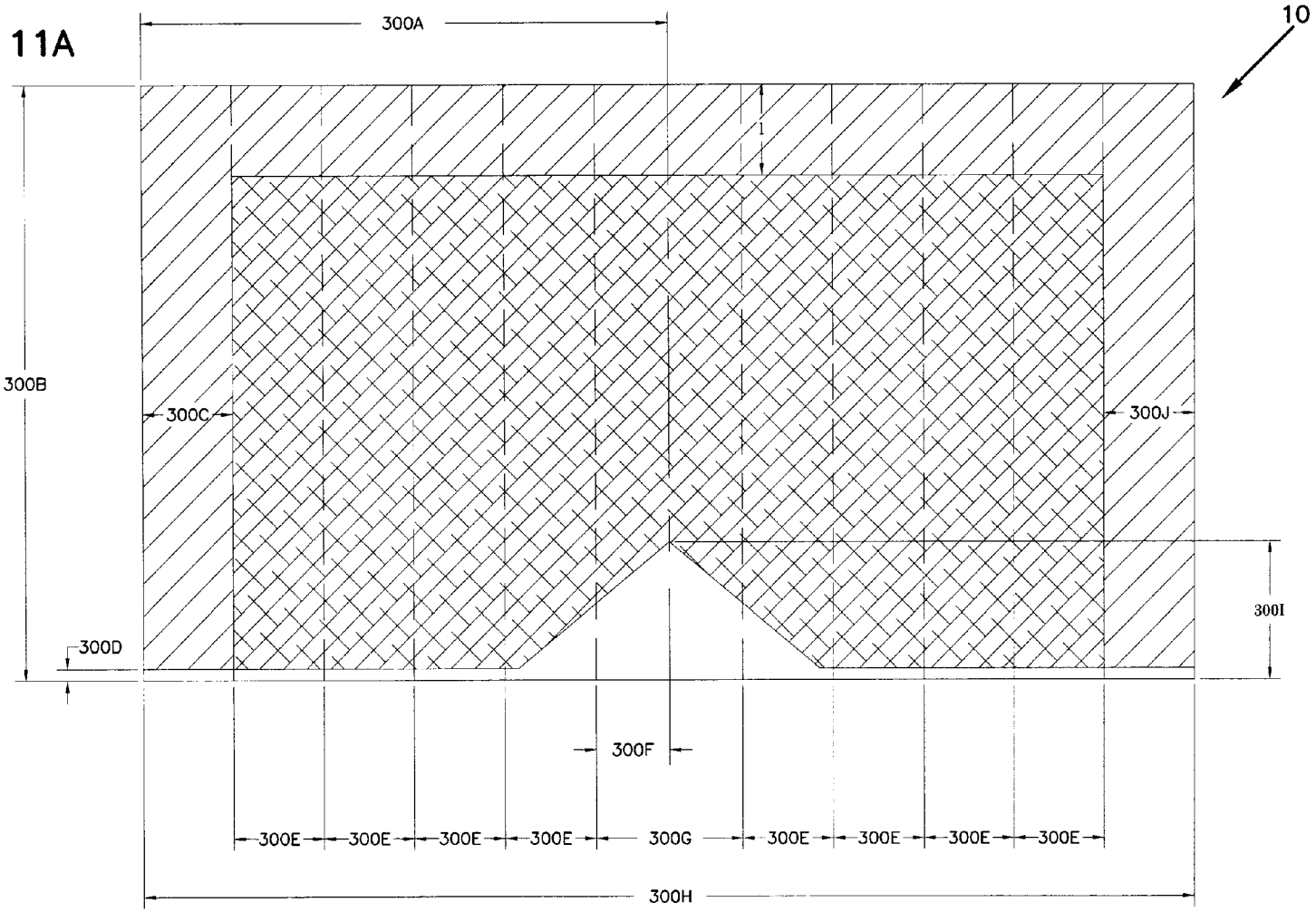
FIG. 11A is a view of FIG. 10A, showing example dimensions and angles for a particular implementation of the microwave popcorn package.
Figure 11B:
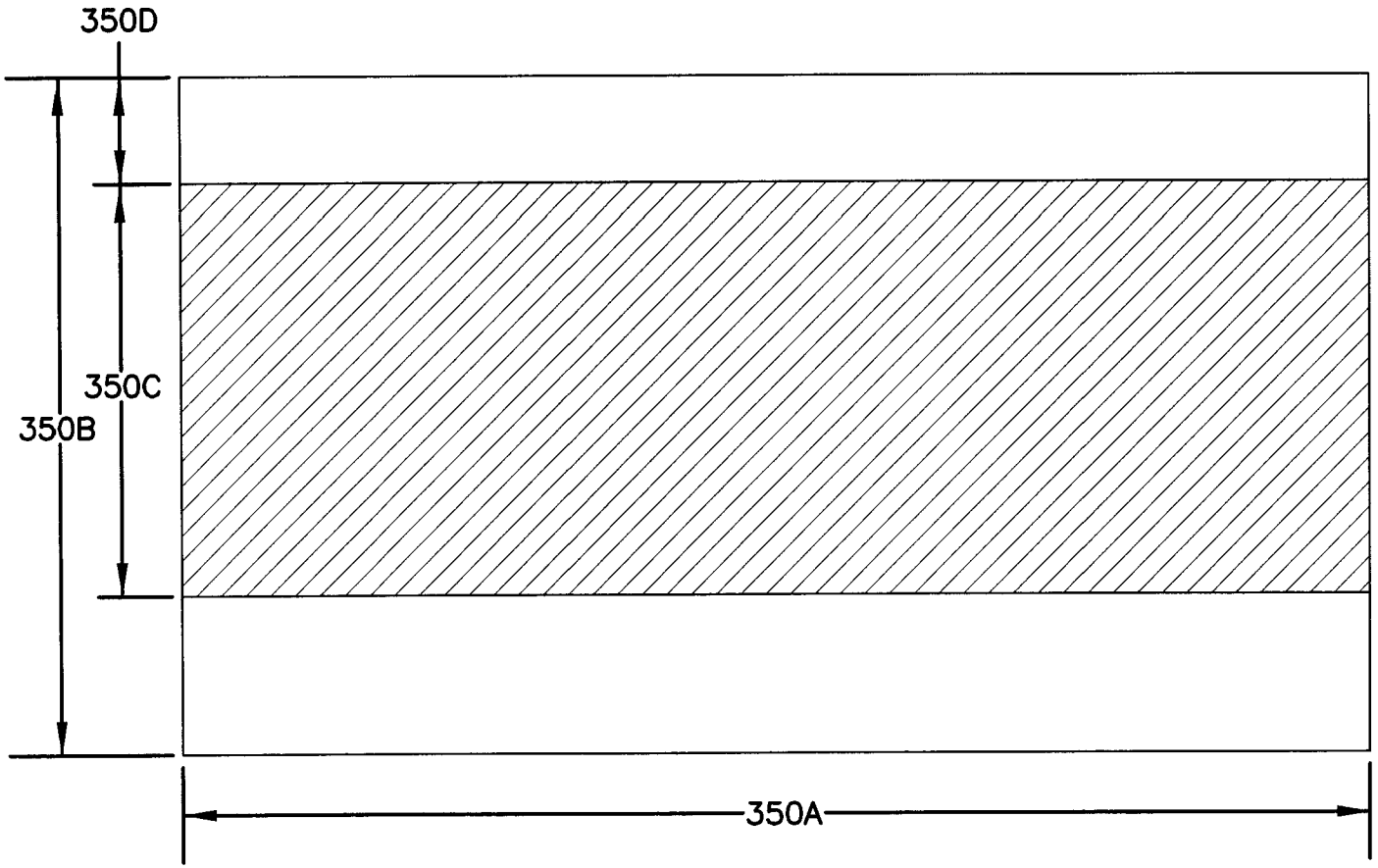
FIG. 11B is a view of FIG. 10B, showing example dimensions for a particular implementation of the microwave popcorn package.

Attention is now directed to FIGS. 11A and 11B. In FIG. 11A, the first panel 10 is depicted analogously to FIG. 10A. Similarly, in FIG. 11B, the first panel 10 is depicted analogously to FIG. 10B.

In FIG. 11A various dimensions of an operable example are indicated, by reference to the following table. A perimeter area for the panel is defined by Dimension 300H by Dimension 300B. A height is Dimension 300B. A width is Dimension 300H.

TABLE 2A

Example Dimensions and Angles for FIG. 10A

| | Angle | | |
|---|---|---|---|
| Dimension | Example | Example Range[1] | Example Range |
| 300A | 5.81 in. (14.76 cm) | 10-20 cm | 12-18 cm |
| 300B | 6.5 in. (16.5 cm) | 10-22 cm | 13-19 cm |
| 300C | 1 in. (2.54 cm) | 1.7-3.5 cm | 1.9-3 cm |
| 300D | 0.125 in. (0.32 cm) | 0.1-0.8 cm | 0.2-0.6 cm |
| 300E | 1 in. (2.54 cm) | 1.5-3.5 cm | 1.9-3 cm |
| 300F | 0.81 in. (2.06 cm) | 1.0-5.0 cm | 1.5-3 cm |
| 300G | 1.625 in. (4.13 cm) | 3-5 cm | 3.5-4.8 cm |
| 300H | 11.625 in. (29.5 cm) | 20-40 cm | 25-35 cm |
| 300I | 1.5 in. (3.8 cm) | 2.5-5 cm | 3.2-4.6 cm |
| 300J | 1 in. (2.54 cm) | 1.8-4.0 cm | 1.9-3 cm |

[1]A wide range, not limited to the values in the table, can be used. In this category, typical values for arrangements like those depicted are provided.

In FIG. 11B various dimensions of an example side panel 10 are indicated, by reference to the following table. A width is Dimension 350A. A height is Dimension 350B. A perimeter area for the panel is defined by Dimension 350A by Dimension 350B.

TABLE 2B

Example Dimensions and Angles for FIG. 10B

| Dimension | Example |
|---|---|
| 350A | 11.625 in. (29.5 cm) |
| 350B | 5.81 in. (14.76 cm) |
| 350C | 3 in. (7.5 cm) |
| 350D | 1.25 in. (3.2 cm) |

Example Assembly and Use

Assembly of the microwave popcorn packages 1 described herein may be accomplished in a number of ways. For example, assembly of the example microwave popcorn package 1 shown in FIG. 2A may generally involve providing the bag blank 90 of FIGS. 8A and 9A, and folding it into a bag construction with sealing as indicated. The resulting folded arrangement may then be positioned between two panels 10, 11, adhered where indicated by the sealant fields of FIGS. 10A and 11A. The popcorn charge may then be distributed into the flexible bag construction 25 into the region adjacent the susceptor 45. Distribution of the popcorn charge into the region 160, FIG. 3A, may be inhibited due to the seals 103, FIG. 8A. The flexible bag construction 25 is next sealed along edge 60, FIG. 5A. Region 40 may then folded over panel 10 along fold line 70.

Assembly of the example microwave popcorn package 1 shown in FIG. 2B may similarly involve providing the bag blank 90*a* of FIGS. 8C and 9B. However, panels 10, 11, and microwave interactive element 45 may be adhered to the bag blank 90*a* where indicated by the sealant fields of FIGS. 10B and 11B before folding. The assembly is then folded into a bag construction 25 and sealed with sealing as indicated. In one example, bag blanks 90*a* and panels 10, 11 may be provided in one or more rolls, which are unrolled and adhered together. Microwave interactive element 45 may likewise be provided in a roll or strip, registered with the bag blank 90*a* (and/or panels 10, 11) and adhered thereto. The assembly may then be cut and folded. The popcorn charge may then be distributed into the flexible bag construction 25 into the region adjacent the microwave interactive element 45, and the flexible bag construction 25 sealed.

The microwave popcorn packages 1 described above may be sealed within a moisture protective outer barrier once assembled, for storage, shipping, and/or display. In use, the package 1 is removed from the moisture barrier outer wrap (in some examples, region 40 [FIG. 3A] may be allowed to unfold or partially unfold) and the package is laid in a microwave oven, with second panel 11 down. A typical construction may be configured to yield full popping within a period of about 2 to 5 minutes, in a typical household microwave oven, on high setting. After popping, the microwave popcorn package 1 may be positioned as shown in FIGS. 5A and 5B, and region 40 (FIG. 6A) or top gusset 39*c* (FIG. 6B) may then be torn from the remainder 26 of the package 1, to yield bowl construction 2, FIGS. 1A and 1B.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A microwave popcorn package comprising:

a sidewall construction, the sidewall construction formed of a vertically rigid material and configured to be expandable between a collapsed configuration and an expanded configuration, the sidewall construction including a first panel and a second panel; and a flexible bag construction including a first side being secured to an inner surface of the first panel of the sidewall construction, a second side being secured to an inner surface of the second panel of the sidewall construction, and a base that extends between the first side and the second side, wherein the base of the flexible bag construction includes an exterior surface of the microwave popcorn package between the first panel and second panel of the sidewall construction, the flexible bag construction configured to be expandable between the collapsed configuration and the expanded configuration, the flexible bag construction and the sidewall construction forming a container having vertically rigid sidewalls in the expanded configuration.

2. A microwave popcorn package as claimed in claim 1, wherein the flexible bag construction further comprises a top that extends between the first side and the second side.

3. A microwave popcorn package as claimed in claim 2, wherein at least a portion of the flexible bag construction is generally transparent to visible light.

4. A microwave popcorn package as claimed in claim 3, wherein the flexible bag construction is fabricated of a polyester film material.

5. A microwave popcorn package as recited in claim 4, wherein the base comprises a base gusset and the top comprises a top gusset, the top gusset configured to be removed from a remainder of the flexible bag construction.

6. A microwave popcorn package as claimed in claim 5, wherein the flexible bag construction is scored within the interior of the sidewall construction to facilitate removal of the top gusset.

7. A microwave popcorn package as claimed in claim 6, further comprising tear tape configured to facilitate removal of the top gusset, the tear tape disposed around the flexible bag construction within the interior of the sidewall construction.

8. A microwave popcorn package as claimed in claim 4, further comprising a plurality of vent slots configured to furnish venting of the flexible bag construction.

9. A microwave popcorn package as claimed in claim 3, wherein at least one of the first panel or the second panel includes a window, the window comprising an opening in a respective one of the first panel or the second panel through which the flexible bag construction is exposed so that contents of the flexible bag construction are visible.

10. A microwave popcorn package as claimed in claim 2, wherein the base comprises a base gusset, the base gusset directed inwardly between the first side and the second side in the collapsed configuration.

11. A microwave popcorn package as claimed in claim 1, wherein the top includes a portion of the flexible bag construction that projects outwardly from the sidewall construction and is configured to be removed from a remainder of the flexible bag construction.

12. A microwave popcorn package as claimed in claim 11, further comprising a tear strip that is selectively removable, the tear strip disposed around the portion of the flexible bag construction that extends outwardly from the sidewall construction.

13. A microwave popcorn package as claimed in claim 1, wherein the sidewall construction defines a ring configuration.

14. A microwave popcorn package as claimed in claim 1, wherein the sidewall construction includes a plurality of creases for adaptation from the collapsed configuration to the expanded configuration.

15. A microwave popcorn package as claimed in claim 1, further comprising a microwave interactive construction positioned in thermoconductive relation to the flexible bag construction.

16. A microwave popcorn package as claimed in claim 15, wherein the flexible bag construction includes an outer ply and an inner ply, the microwave interactive construction positioned between the outer ply and the inner ply.

17. A microwave popcorn package comprising:

a sidewall construction, the sidewall construction including a first panel and a second panel; and a flexible bag construction including a first side secured to an inner surface of the first panel, a second side secured to an inner surface of the second panel, and a bottom that extends between the first side and the second side, at least a portion of the flexible bag construction being generally transparent to visible light, the sidewall construction and the flexible bag construction configured to be expandable between a collapsed configuration and an expanded configuration and to form a container having vertically rigid sidewalls in the expanded configuration, wherein the bottom of the flexible bag construction includes an exterior surface of the microwave popcorn package between the first panel and second panel of the sidewall construction.

18. A microwave popcorn package as claimed in claim 17, wherein the flexible bag construction is fabricated of a polyester film material.

19. A microwave popcorn package as claimed in claim 18, wherein the polyester film material comprises biaxially-oriented polyethylene terephthalate (PET).

20. A microwave popcorn package as recited in claim 18, wherein the flexible bag construction further includes a top, the bottom comprises a base gusset and the top comprises a top gusset, the top gusset configured to be removed from a remainder of the flexible bag construction.

21. A microwave popcorn package as claimed in claim 20, wherein the flexible bag construction is scored within the interior of the sidewall construction to facilitate removal of the top gusset.

22. A microwave popcorn package as claimed in claim 20, further comprising tear tape configured to facilitate removal of the top gusset, the tear tape disposed around the flexible bag construction within the interior of the sidewall construction.

23. A microwave popcorn package as claimed in claim 18, further comprising a plurality of vent slots configured to furnish venting of the flexible bag construction.

24. A microwave popcorn package as claimed in claim 23, wherein the vent slots are comprised of lines scored in the polyester film that open to vent the flexible bag construction.

25. A microwave popcorn package as claimed in claim 17, further comprising a microwave interactive construction positioned in thermoconductive relation to the flexible bag construction.

26. A microwave popcorn package as claimed in claim 25, wherein the flexible bag construction comprises a single-ply and the microwave interactive construction is attached to the single-ply.

27. A microwave popcorn package as claimed in claim 25, wherein the microwave interactive construction is attached to the interior of the sidewall construction.

28. A microwave popcorn package as claimed in claim 25, wherein the microwave interactive construction comprises a low optical density microwave susceptor.

29. A microwave popcorn package as claimed in claim 25, wherein the microwave interactive construction comprises a patterned microwave susceptor.

30. A microwave popcorn package as claimed in claim 25, further comprising an insulator disposed between the microwave interactive construction and the flexible bag construction.

31. A microwave popcorn package comprising:

a sidewall construction having a first panel and a second panel;

a flexible bag construction configured to receive a charge of popcorn, at least a portion of the flexible bag construction being generally transparent to visible light and having a first side being secured to an interior surface of the first panel, a second side being secured to an interior surface of the second panel, and a base gusset that extends between the first side and the second side; and a microwave interactive construction positioned in thermoconductive relation to the flexible bag construction, the microwave interactive construction operable to heat the charge of popcorn during a popping operation, the sidewall construction and the flexible bag construction configured to be expandable between a collapsed configuration and an expanded configuration and to form a container having vertically rigid sidewalls in the expanded configuration, contents of the flexible bag construction being visible through at least a portion of the flexible bag construction in the expanded configuration, wherein the base of the flexible bag construction includes an exterior surface of the microwave popcorn package between the first panel and second panel of the sidewall construction.

32. A microwave popcorn package as claimed in claim 31, wherein the flexible bag construction is fabricated of a polyester film material.

33. A microwave popcorn package as claimed in claim 32, wherein the polyester film material comprises biaxially-oriented polyethylene terephthalate (PET).

34. A microwave popcorn package as claimed in claim 32, wherein the flexible bag construction includes a top gusset that extends between the first side and the second side of the flexible bag construction, the top gusset configured for being removed from a remainder of the flexible bag construction and the flexible bag construction being scored within the interior of the sidewall construction to facilitate removal of the top gusset.

35. A microwave popcorn package as claimed in claim 34, further comprising tear tape configured to facilitate removal of the top gusset, the tear tape disposed around the flexible bag construction within the interior of the sidewall construction.

36. A microwave popcorn package as claimed in claim 31, further comprising a plurality of vent slots configured to furnish venting of the flexible bag construction.

37. A microwave popcorn package as claimed in claim 36, wherein the vent slots are comprised of lines scored in the polyester film that open to vent the flexible bag construction.

* * * * *